US008001795B2

(12) United States Patent
Pfister et al.

(10) Patent No.: US 8,001,795 B2
(45) Date of Patent: Aug. 23, 2011

(54) METHOD OF ADJUSTING TEMPERATURES OF PRODUCTS TO DESIRED PRODUCT TEMPERATURES

(75) Inventors: Steven C. Pfister, Dunwoody, GA (US); Brock Kolls, Alpharetta, GA (US); Carlos A. Barreto, Atlanta, GA (US); Mathew Scott Reichardt, Atlanta, GA (US); Thomas P. Howell, Suwanee, GA (US); Willy Van Esch, Grez-Doiceau (BE)

(73) Assignee: The Coca-Cola Company, Atlanta, GA (US)

( * ) Notice: Subject to any disclaimer, the term of this patent is extended or adjusted under 35 U.S.C. 154(b) by 1060 days.

(21) Appl. No.: 11/829,133

(22) Filed: Jul. 27, 2007

(65) Prior Publication Data

US 2009/0029016 A1 Jan. 29, 2009

(51) Int. Cl.
*F25D 3/00* (2006.01)
*F25D 25/00* (2006.01)

(52) U.S. Cl. ..... 62/62; 62/393; 62/396

(58) Field of Classification Search ..... 62/62, 63, 62/389, 393, 396; 222/146.6; 99/483, 485
See application file for complete search history.

(56) References Cited

U.S. PATENT DOCUMENTS

| | | | | |
|---|---|---|---|---|
| 4,368,622 | A | 1/1983 | Brooks | |
| 5,671,604 | A * | 9/1997 | Rudick | 62/52.1 |
| 6,347,523 | B1 | 2/2002 | Barrash et al. | |
| 2003/0172663 | A1 * | 9/2003 | Cartwright et al. | 62/126 |
| 2006/0185372 | A1 | 8/2006 | Conde | |
| 2007/0101734 | A1 | 5/2007 | Lucas | |
| 2007/0151284 | A1 | 7/2007 | Freesmeier et al. | |

FOREIGN PATENT DOCUMENTS

| | | |
|---|---|---|
| EP | 1662218 | 5/2006 |
| FR | 2788677 | 7/2000 |
| SU | 884620 B | * 11/1981 |
| WO | 97/35155 | 9/1997 |
| WO | 2004/017001 | 2/2004 |
| WO | 2004/017268 | 2/2004 |

* cited by examiner

*Primary Examiner* — Marc E Norman
(74) *Attorney, Agent, or Firm* — Sutherland Asbill & Brennan, LLP

(57) ABSTRACT

A method of adjusting temperatures of products to a desired product temperature. The method may include enabling the selection of a product, enabling the selection of the desired product temperature, enabling the placement of the product into a temperature adjust device, circulating a liquid or a gas through the temperature adjust device, the liquid or the gas having been cooled to a cool temperature less than the desired product temperature or heated to a warm temperature greater than the desired product temperature, determining when the desired product temperature has been obtained, and ceasing circulation of the liquid or a gas through the temperature adjust device.

37 Claims, 25 Drawing Sheets

350

METHOD OF ADJUSTING TEMPERATURES OF PRODUCTS TO DESIRED PRODUCT TEMPERATURES

TECHNICAL FIELD OF THE INVENTION

The present application relates generally to dispensing equipment and more particularly relates to dispensing equipment that can heat or chill products according to a consumer's instructions.

BACKGROUND OF THE INVENTION

In order to serve a ready to drink beverage or other type of consumable product from a vending machine or cooler, an inventory of products, sometimes numbering in the hundreds or thousands, generally had to be cooled or heated to a ready to serve temperature. This temperature "pull down" process can take an extended period of time and generally involves the entire inventory. For example, it may take hours before the temperature of the entire inventory of a vending machine has been lowered to a ready to server temperature. Many commercial establishments, however, may turn the power off to the vending equipment or coolers in the evening to save energy but also allowing the products therein to warm. As such, a consumer may receive a product that is not at an acceptable temperature when the store reopens.

Furthermore, consumer preferences even vary on how hot is hot and how cold is cold. The consumer therefore may desire to determine the temperature of an individually served product. In addition, consumers may desire hot or cold beverages. For example, some consumers like their tea hot and some like it cold.

Current vending equipment technology offers hot and cold zones within a vending machine. These devices, however, heat entire regions and mass quantities of products such that the temperature pull down to serving temperatures still may be a lengthy process. Additionally, storing beverages and other products at a hot temperature for extended period of time may cause premature product quality degradation. Maintaining a high or low ready to serve temperature also continuously consumes energy.

Thus, there is a desire for an improved vending machine, cooler, and other types of dispensing devices that provide more flexibility in varying serving temperatures and providing quality on demand beverages. Such a vending machine or other device preferably can provide such temperature flexibility while consuming less energy than known units.

SUMMARY OF THE INVENTION

The present application therefore provides a method of adjusting a temperature of a product to a desired product temperature. The method may include enabling the selection of a product, enabling the selection of the desired product temperature, enabling the placement of the product into a temperature adjust device, circulating a liquid or a gas through the temperature adjust device, the liquid or the gas having been cooled to a cool temperature less than the desired product temperature or heated to a warm temperature greater than the desired product temperature, determining when the desired product temperature has been obtained, and ceasing circulation of the liquid or a gas through the temperature adjust device.

The method further may include maintaining a product storage area with the product stored at a refrigerated elevated temperature, agitating the product by using ultrasound or high frequency signals, communicating with a wireless device to obtain a number of consumer preferences including a desired product temperature preference, displaying a time remaining until the product obtains the desired product temperature, communicating with a wireless device to effectuate payment for the product, determining the desired product temperature in part by determining a consumer's body temperature, informing a consumer that the product has reached the desired product temperature, frosting indicia onto a package for the product, or allowing the temperature adjust device to return to ambient temperature.

The present application further provides a system for adjusting a temperature of a product to a desired product temperature. The system may include a temperature adjust device, a main space maintained at a temperature either less or greater than the desired product temperature, and a circulation device. Responsive to a product being placed in the temperature adjust device, the circulation device circulates a liquid or a gas from the main space through the temperature adjust device until the product has transitioned to the desired product temperature.

The system further may include an agitator for agitation of the product. The system further may include a product storage area maintained at a refrigerated elevated temperature. The temperature adjust device may include a frost inlet for frosting the product. The system further may include a consumer interface such that a consumer can select the desired product temperature, a wireless device interface for communicating consumer preferences or payment information, a biometric sensor, and a temperature sensor. The temperature sensor may include an infra-red temperature sensor. The temperature adjust device may include a clamp.

The present application further describes a method of empowering consumers to select a desired product temperature of a product at a point of consumption. The method may include allowing a consumer to request the product, the product being stored at a temperature either higher or lower than the desired product temperature, prompting the consumer to select the desired product temperature, and transitioning the product to the desired product temperature.

The method further may include determining a rate of temperature change of the product, displaying an amount of time remaining until the product completes the transition to the desired product temperature, allowing the consumer to provide a text or a graphic indicia, obtaining a number of consumer preferences from a wireless device, frosting the text or the graphic indicia onto a package for the product, agitating the product, or determining the desired product temperature in part by determining a consumer's body temperature. The prompting includes measuring the temperature of the consumer to determine in part the desired product temperature.

The present application further describes an apparatus for a number of products. The apparatus may include a mechanism for storing the products and a temperature adjust device operationally related to the mechanism. The temperature adjust device may include a clamp so as to circulate a liquid or a gas through the clamp when one of the products is therein so as to obtain a desired product temperature.

The mechanism may include a main refrigerated space maintained at a cool temperature less than the desired product temperature. The mechanism may include a heat rejection space maintained at a warm temperature greater than the desired product temperature. The temperature adjust device may include an agitator. The agitator may include ultrasound or high frequency signals, The apparatus further may include a consumer interface accessible to a consumer. The mechanism may include an 'X'-'Y' picker. The mechanism may include a vending machine, a cooler, or a fountain dispenser. The apparatus further may include an infra-red temperature sensor.

These and other features of the present application will become apparent to one of ordinary skill in the art upon review of the following detailed description when taken in conjunction with the several drawings and the appended claims.

DETAILED DESCRIPTION OF THE INVENTION

Figure 1A:
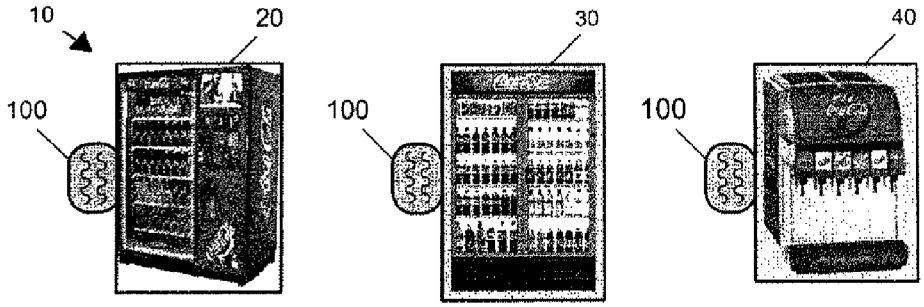
FIG. 1A is a perspective view of a hot and/or cold device attached to vending equipment as is described herein.

Referring now to the drawings, in which like numerals indicate like parts throughout the several views, FIG. 1A shows a number of dispensing devices 10. In this example, a vending machine 20, a cooler 30, and a beverage dispenser 40 are shown. An example of a hot and/or cold device 100 as is described herein can be retrofit or otherwise attached to the dispensing devices 10. The dispensing devices 10 may have a number of beverages or products 50 therein. The products 50 may be manufactured from plastic, PET, aluminum, aluminum contoured bottles, glass, and/or other types and kinds of materials as may be desired.

By way of example, a consumer may obtain a beverage or other product 50 from the dispensing device 10 and then use the hot and/or cold device 100 to adjust the temperature of the contents of the beverage or other product 50 to a desired temperature. The desired temperature may be a temperature that is predetermined to be the serving and/or consuming temperature or the desired temperature may be a temperature selected by the consumer and/or determined based on the consumer's preferences.

Figure 1B:
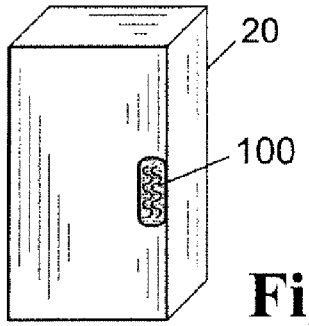
FIG. 1B is a perspective view of a hot and/or cold device attached to vending equipment as is described herein.

FIG. 1B shows the hot and/or cold device 100 attached to the vending machine 20. The product 50 may be dispensed initially into the hot and/or cold device 100 such that the product temperature may be adjusted as desired. The product 50 then may be dispensed to the consumer once the desired product temperature is obtained.

Figure 1C:
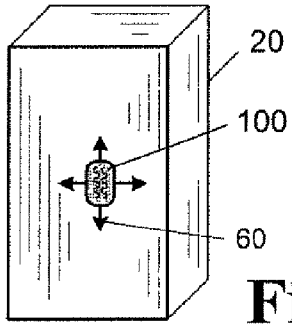
FIG. 1C is a perspective view of a hot and/or cold device attached to an 'X'-'Y' type of vending mechanism being used in a vending machine.

FIG. 1C shows the hot and/or cold device 100 attached to an 'X'-'Y' vending mechanism 60 within a vending machine 20. The 'X'-'Y' vending mechanism 60, also referred to as a picker, accesses a product location by moving the hot and/or cold device 100 to the product location coordinates. As is known, such 'X'-'Y' vending mechanisms 60 also may include elevator type vend mechanism, wherein a horizontal conveyer system rises to the appropriate product level. The product 50 may be dispensed into the hot and/or cold device 100 and then dispensed to the consumer. An example of a 'X'-'Y' vending mechanism 60 is shown in commonly owned U.S. Pat. No. 6,682,289, entitled "Dispensing Apparatus and Method of Using the Same, incorporated herein by reference.

Figure 1D:
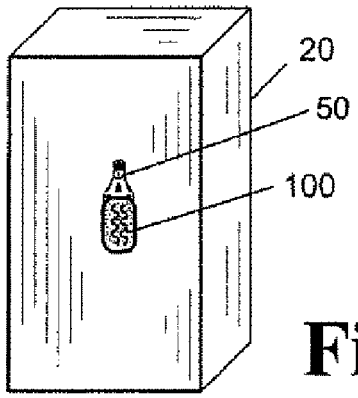
FIG. 1D is a perspective view of a hot and/or cold device, wherein a beverage or other product is preloaded.

FIG. 1D shows the hot and/or cold device 100 with a beverage or other product 50 loaded therein. The beverage or other product 50 may be obtained from a product inventory and held in the hot and/or cold device 100. The product 50 therefore may be maintained at the desired product temperature when a consumer elects to dispense the beverage or other product 50. Such dispensing can be effectuated faster as compared to having to obtain the product 50 from the product inventory and then adjusting the product temperature to the desired product temperature prior to dispensing. Should a consumer elect to dispense a product 50 other then the product 50 being held in the hot and/or cold device 100, the product 50 in the hot and/or cold device 100 may first be removed, an alternative product obtained, the alternative product prepared and dispensed, and then the original product 50 may be returned to the hot and/or cold device 100.

Figure 1E:
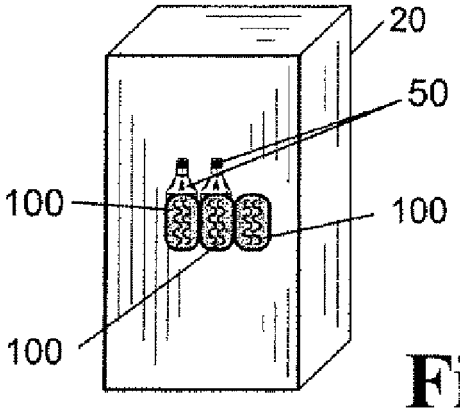
FIG. 1E is a perspective view of multiple hot and/or cold devices, wherein multiple beverages or other products can be preloaded.

FIG. 1E shows multiple hot and/or cold devices 100 wherein multiple beverages or other products 50 may be preloaded. Optionally, at least one hot and/or cold device 100 may be left unoccupied such that if the consumer elects to dispense a product type other then the preloaded product 50, the unoccupied hot and/or cold device 100 may be used to obtain, prepare, and dispense the consumer selected product.

Figure 1F:
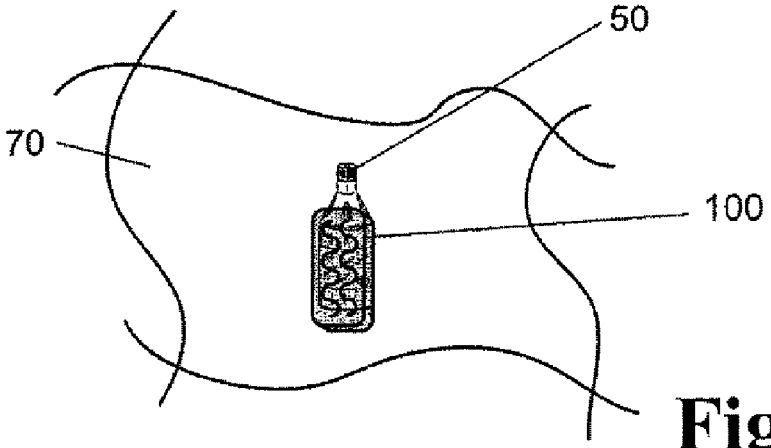
FIG. 1F is a perspective view of a hot and/or cold device attached to a surface.

FIG. 1F shows the hot and/or cold device 100 attached to a surface 70. For example, the hot and/or cold device 100 may be attached to surfaces 70 such as walls, cabinets, and/or other types and kinds of surfaces as may be desired. Specifically, the surface may be a table, a store shelf, a check out counter, or any location in a home or commercial establishment.

Figure 1G:
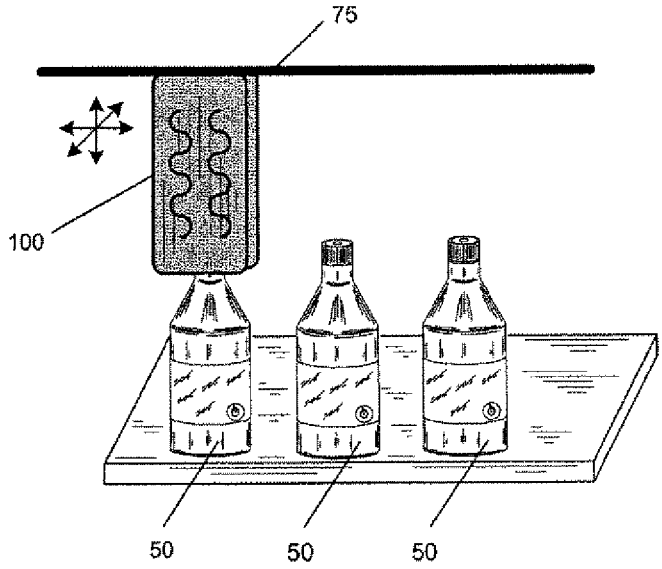
FIG. 1G is a perspective view of a hot and/or cold device attached to a surface above the products.

FIG. 1G shows the hot and/or cold device 100 attached to a surface 75 above a number of the products 50. The products 50 may be orientated such that the hot and/or cold device 100 may be operationally related to the surface 75. In this regard, the hot and/or cold device 100 may be positioned in an 'X', 'Y', and/or 'Z' plane such that heating or cooling of the products 50 may be effectuated.

Figure 2A:
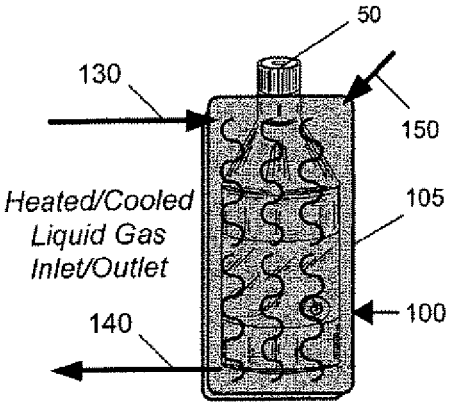
FIG. 2A is a perspective view of a hot and/or cold device holding a product.
Figure 2B:
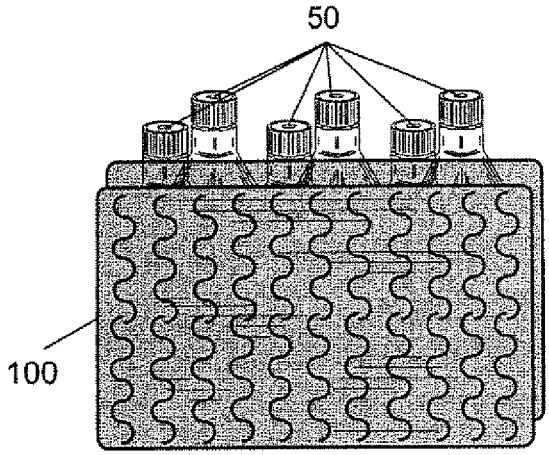
FIG. 2B is a perspective view of a hot and/or cold device, wherein multiple beverages or other products can be temperature adjusted at the same time.

FIG. 2A shows one example of the hot and/or cold device 100 holding a product 50. The hot and/or cold device 100 in this example may be in the form of a clamp 105 surrounding the product or products 50. Although the term clamp is used herein, the hot and/or cold device may take any form that substantially surrounds most or all of the packing of the product 50. The clamp 105 may be made out of a light weight heat transfer material. The outer part of the claim 105 may be insulated. FIG. 2B shows one example of the hot and/or cold device 100 with multiple beverages or other products 50. The temperature of the products 50 may be adjusted at the same time.

FIGS. 2A, 2B and 3A-3H show examples of the use of the clamp 105. Specifically, a liquid or gas may be heated by way of a heat rejection space 110 or a liquid or gas may be cooled by way of a main refrigerated space 120. The heated or cooled liquid or gas then may be circulated on demand through the hot and/or cold device 100 by way of an inlet 130 and outlet 140. A number of inlets 130 and outlet 140 may be used to allow hot or cold liquids and/or gases to be circulated on demand through the clamp 105. The clamp 105 may be used for both hot and cold application or two (2) or more clamps 105 may be used. In addition, should steam, frost, or other substances be introduced at the product clamp 100 interface during product temperature adjustment, such substance can be introduced by way of inlet 150 and expelled as may be required and/or desired in a particular embodiment.

Figure 3A:
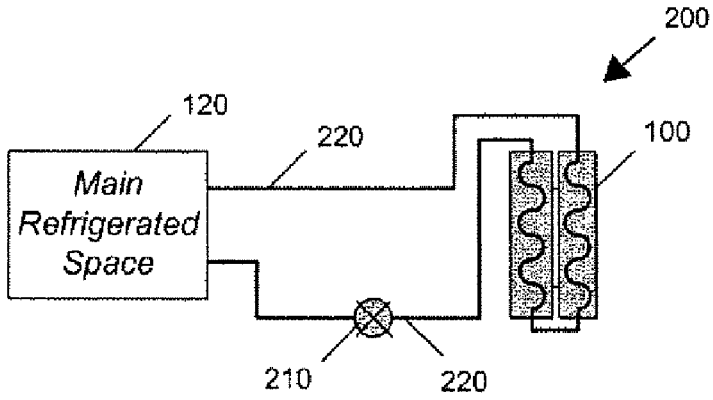
FIG. 3A is a schematic view of a hot and/or cold system configured for a cold application.

FIG. 3A shows one example of a hot and/or cold system 200 configured for cold applications. The main refrigerated space 120 may be cooled to a temperature in the range of −40 degrees Celsius or lower. The main refrigerated space may be cooled via a Rankine cycle engine, a Stirling cycle engine, a vapor compression device, and similar types of cooling devices. An example of a Stirling cycle engine used for quick chilling purposes is shown in commonly owned U.S. Pat. No. 6,347,523, entitled "Apparatus Using Stirling Cooler System and Methods of Use", incorporated herein by reference. The main refrigerated space 120 may be compact for efficiency. The products 50 generally are not stored in the main refrigerator space 120 or the heat rejection space 130.

In operation, a valve/pump 210 may be controlled to induce the circulation of extremely cold liquid or gas through tubing 220, and through the clamp 105. The clamp 105 thus rapidly cools and thus rapidly cools the beverage or other product 50 being held by the clamp 105. When the desired product temperature is obtained, the valve/pump 210 closes and the cooled beverage or other product 50 may be dispensed to a consumer or retained for a prospective next consumer. The valve/pump 210 may be any type of conventional circulation device.

An advantage of this method of quick cooling is that by using a main refrigerated space 12 and only cooling the clamp 105 as needed, potential frost build up at the clamp 105 may be avoided. The clamp 105 may be made out of a light weight heat transfer material. The outer part of the claim 105 may be insulated. Frost or ice accumulation generally requires defrost cycles. The clamp 105 herein may be allowed to remain at above freezing temperatures during nonuse and as such frost and ice buildup over time does not form on the clamp 105 and no defrost cycle may be required. Because frost and ice do not form on the clamp 105, condensation resulting from the defrost cycle generally is not a concern and does not need to be managed to avoid water damage.

Figure 3B:
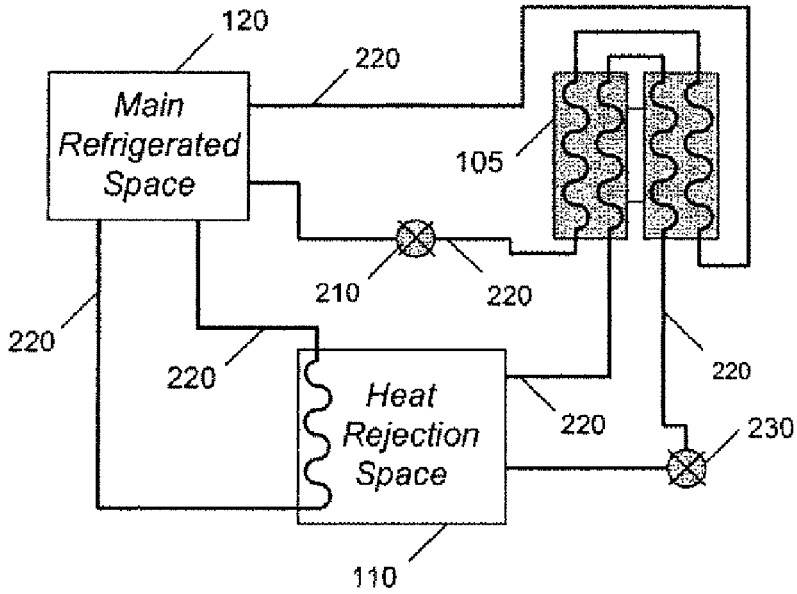
FIG. 3B is a schematic view of a hot and/or cold system configured for a hot and/or cold application.

FIG. 3B shows another example of the hot and/or cold system 200 configured for a hot and/or cold application. Heat or cold may be applied to a single clamp 105 or separately applied to multiple clamps 105. In this regard, products 50 that require a heated product temperature and products 50 that require a cold product temperature may be dispensed and temperature adjusted by the clamp 105 as may desired.

With respect to heating, the heat rejection space 110 may be maintained by way of heat rejection from main refrigerated space 120. The heat can be transferred by way of tubing 220 to the heat rejection space 110. The heat rejection space 110 may be used to heat and maintain secondary liquids and/or gases to a very hot temperature of about +90 degree Celsius or higher or lower as needed for specific applications. A valve/pump 230 may be controlled such that the secondary hot liquid and/or gases may be circulated through the tubing 220 and the clamp 105. The valve/pump 230 may be any type of conventional circulation device.

Figure 3C:
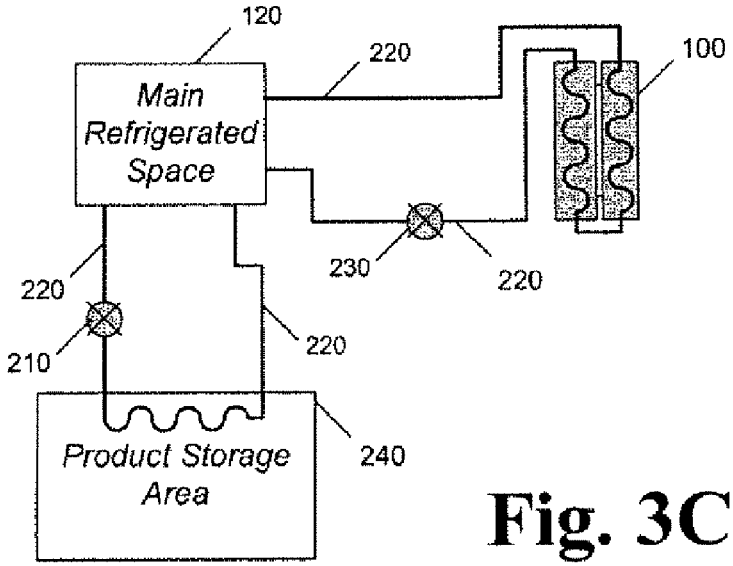
FIG. 3C is a schematic view of a hot and/or cold system configured for a cold application having an elevated temperature product storage area.

FIG. 3C shows one example of the hot and/or cold system 200 configured for a cold application and having an elevated temperature product storage area 240. The product storage area 240 may be a space where the products 50 may be stored prior to dispense. In this regard, the products 50 may be protected from temperature extremes. Too hot conditions may cause the products 50 to deteriorate prematurely such that taste and/or quality of the products 50 may be compromised. Too cold conditions may cause the products 50 to freeze. In addition, extreme temperature conditions may create a situation where heating or cooling to the desired product temperature may take too long. In this regard, a large temperature difference between the product storage temperature area 240 and the desired product temperature may take longer then may be acceptable to a consumer. The product storage area 240 also may be maintained at an elevated temperature for energy savings. In this regard, the product storage area 240 may be maintained at a temperature in the range of room temperature. A valve/pump 250 and the tubing 220 may maintain the product storage area 240 at the predetermined refrigerated elevated temperature. The valve/pump 250 may be any type of conventional circulation device.

The elevated temperatures of the product storage area 240 may be selected such that the amount of time to heat or cool to the desired product temperature may be equalized. By determining the rate of temperature change for heating the product 50 and for cooling the product 50 to the desired product temperature, a refrigerated elevated temperature that is equally distance, from a rate of change perspective, to the desired product temperature may be selected. In operation, this may allow heated beverages and other products 50 and cooled beverages and other products 50 to reach the desired product temperature in about the same or a similar amount of time.

When the product storage area 240 is maintained at a refrigerated elevated temperature or otherwise maintained at room temperature, both beverages and other products 50 as well as food products may be dispensed from the same vending equipment. Because the beverages and other products 50 may be adjusted to a desired product temperature, the food products may be stored in the same area as the products 50. For example, a beverage or other product 50 and a food or snack item may be dispensed from the same vending equipment. This ability thus provides promotional opportunities to bundle food and drink. This is in contrast to known equipment where a refrigerated compartment for a beverage or other product may have been too cold to store snack food such that dispensing a cold drink and a food item from the same product storage area was not practical.

FIG. 3C shows the valve/pump 210 and the tubing 220 maintaining the product storage area 240 at a predetermined refrigerated elevated temperature. In addition, the valve/pump 230, the tubing 220, and the clamp 105 provide quick cooling of a product 50.

Figure 3D:
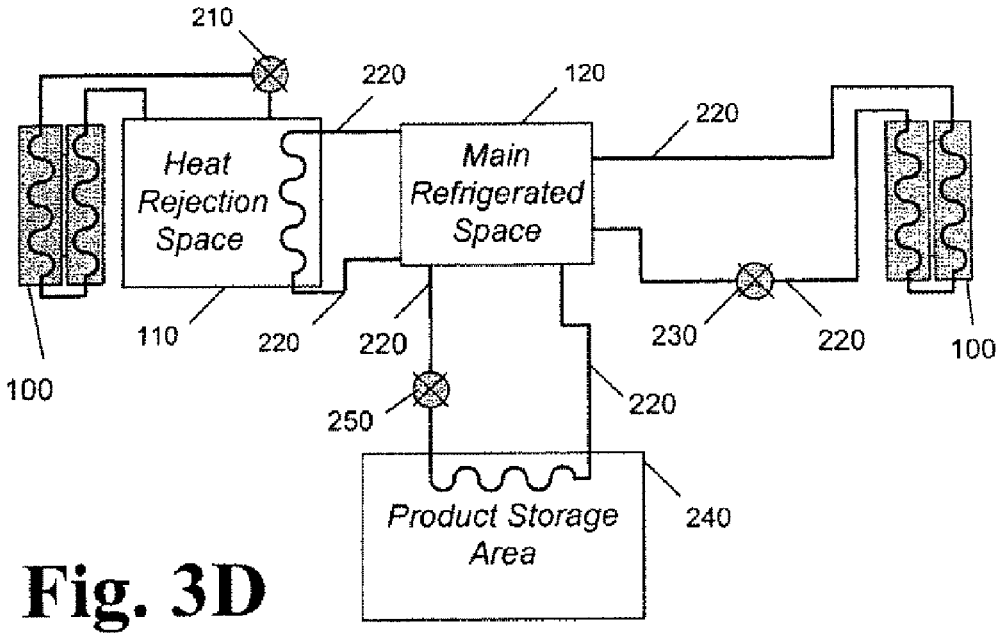
FIG. 3D is a schematic view of a hot and/or cold system configured for a hot and/or cold application having a product storage area refrigerated to an elevated temperature.

FIG. 3D shows one example of the hot and/or cold system 200 configured for a hot and/or cold application having a product storage area 240 refrigerated to an elevated temperature. The products 50 may be heated or cooled to a desired product temperature and the product storage area 240 may be maintained at a predetermined refrigerated elevated temperature. The heat rejection space 110 may be maintained by way of heat rejection from the main refrigerated space 120. The heat may be transferred by way of the tubing 220 to the heat rejection space 110.

Figure 3E:
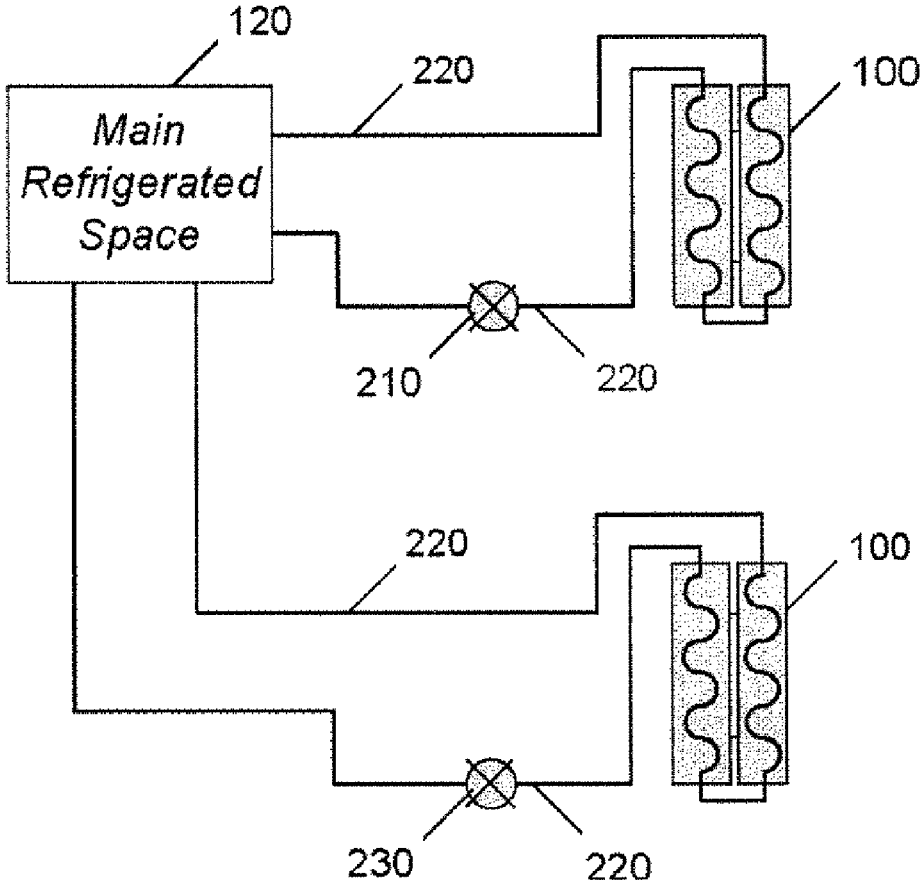
FIG. 3E is a schematic view of a hot and/or cold system 200 configured for a cold application having multiple cold devices.

FIG. 3E shows an example of the hot and/or cold system 200 configured for a cold application having multiple cold devices 100. Specifically a number of the clamps 105 may be utilized. While one product 50 is being cooled, a second product 50 also may be obtained and also cooled. An advantage is that a higher throughput of beverages or other products 50 may be achieved from a single vend mechanism when a second or an additional product 50 may be obtained and cooled while a first or initial product 50 is being cooled. A consumer may dispense the first product 50 into the clamp 105 and the cooling process may then be started. The consumer then may select a second product 50 to dispense and cooled in the clamp 100. Hot, cold, or a combination of hot and cold clamps 105 also may be utilized to provide the number of clamps 105 to quick heat and/or cool a number of products 50 as may be desired.

The main refrigerated space 120 may be used to cool the liquids and/or gases to a very cold temperature in the range of −40 degrees Celsius or colder or hotter depending upon specific applications for desired temperature and temperature adjustment time periods. When desired, the valve/pump 210 and/or 230 may be opened such that the cold liquid and/or gases may be circulated through the tubing 220 and the clamp 105. In this regard, two products 50 may be obtained one at a time from a vend mechanism and cooled to the desired product temperature.

Figure 3F:
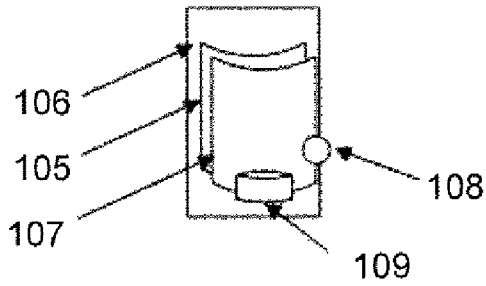
FIG. 3F is a plan view of the product clamp as used in the hot and/or cold system 200.

FIG. 3F shows further details on the clamp 105. The clamp 105 as a whole may include a package cradle 106, a product heat exchanger 107, a product temperature sensor 108, and a product proximity sensor 109. The cooling or heating liquid provides the heat transfer to the clamp 105 through the liquid coolant tubing 220 attached to the heat exchanger 107. The valve/pump 210, 230, 250 pumps the coolant thru the heat exchanger 107 when activated by the controls. The controls, as described in more detail below, may receive a signal from the product proximity sensor 109 and the product temperature sensor 108. The product proximity sensor 109 may be based on light detection, a pressure switch, or similar means.

For the cooling embodiment, the controller detects a product 50 and the product temperature sensor 108 compares the temperature to the desired value. The typical location of the product temperature sensor 108 may be on the fluid exiting the heat exchanger 107. The valve/pump 210, 230, 250 allows the coolant to flow while the product temperature is above the desired temperature. When the desired temperature is reached, the valve/pump 210, 230, 250 stops the coolant from flowing.

For the heating embodiment, the controller detects the product 50 and the product temperature and compares the temperature to the desired value. The valve/pump 210, 230, 250 allows the coolant to flow while the product temperature is below the desired temperature. When the desired temperature is reached, the valve/pump 210, 230, 250 stops the coolant from flowing.

For the cooling and heating embodiment, the controller detects a product 50 and the product temperature and compares the temperature to the desired value. The controller determines which valve/pump 210, 230, 250 to activate in order to provide the desired temperature being either heating or cooling. When the desired temperature is reached, the valve/pump 210, 230, 250 stops the coolant from flowing.

Another embodiment of the hot and/or cold device 100 does not require a proximity switch, but may rely on a default room temperature setting. In this embodiment, the consumer may adjust the desired temperature up or down from the default. As soon as the desired temperature is reached, the controller resets the desired temperature back the default until the next customer requests a temperature.

The temperature sensor 108 can utilize conventional thermocouples placed inside or on the exterior of the coolant lines to sense the product temperature. Temperature offset algorithms can be programmed into the controller for greater precision. Another embodiment of the temperature sensor is to implement infrared temperature measurement such that the surface of the product 50 may be measured directly.

The ideal fluid used for heating or cooling may be selected from fluids available that are in the liquid state over the required operating range. The operating range for the cold fluid is expected to be between about −50 C and about +40 C. The operating range for the heating fluid is expected to be between about −20 C and about +100 C. Both fluids should remain in the liquid state over typical storage temperature ranges from −40 C to +50 C. Liquid phase fluids (single phase) are ideal because the heat exchanger can be designed to operate with little pressure differential. If the working fluids can be maintained as a similar pressure to the atmospheric pressure, the heat exchanger wall thickness can be minimized. Minimizing the heat exchanger wall thickness also minimizes the heat capacity of the heat transfer assembly and minimizes the time required to heat or cool the product 50.

In another embodiment of the design, fluids may be chosen to have liquid and gaseous states in the prescribed range of temperatures. Multi-phase fluids may be chosen for cost, availability, or to improve the thermal characteristics of the system. Multi-phase fluids may improve the heat transfer; however, multi-phase fluids may require thicker heat exchanger walls to maintain a greater pressure differential from the atmosphere.

The product heat exchanger 107 may be constructed of thin light weight material to minimize the thermal mass of the heat transfer assembly. The product heat exchanger 107 may be constructed of flexible material that can conform to the shape of various packages. The product heat exchanger 107 may be constructed from plastic or metallic materials.

Another embodiment of the design may use a heat exchanger that matches the contour of a specific product and is not compliant or flexible. This embodiment may offer superior heat transfer but can only be used with one product shape.

The clamp 105 may be constructed of an inflatable bladder. Using air in the bladder provides ideal insulating characteristic for the clamp 105. The clamp 105 may be constructed of insulating material to prevent heat transfer to the atmosphere. The most efficient design completely insulates the product 50 and the heat exchanger 107 from the ambient air temperature.

Another embodiment of the clamp 105 may be a mechanical clamp 105 that does not utilize the inflatable bladder. The mechanical clamp 105 may be constructed at a lower cost and may be sufficient for applications with less variation in package shapes.

Another embodiment of the clamp 105 allows for temperature control by adjusting the flow rate of the working fluids. Various product target temperatures could be achieved by applying various flow rates. Flow rates may also be adjusted to match the temperature differential between the product 105 and the temperature sensor 108. Applying the proper algorithm to the controller allows for precise control of the product temperature.

Figure 3G:
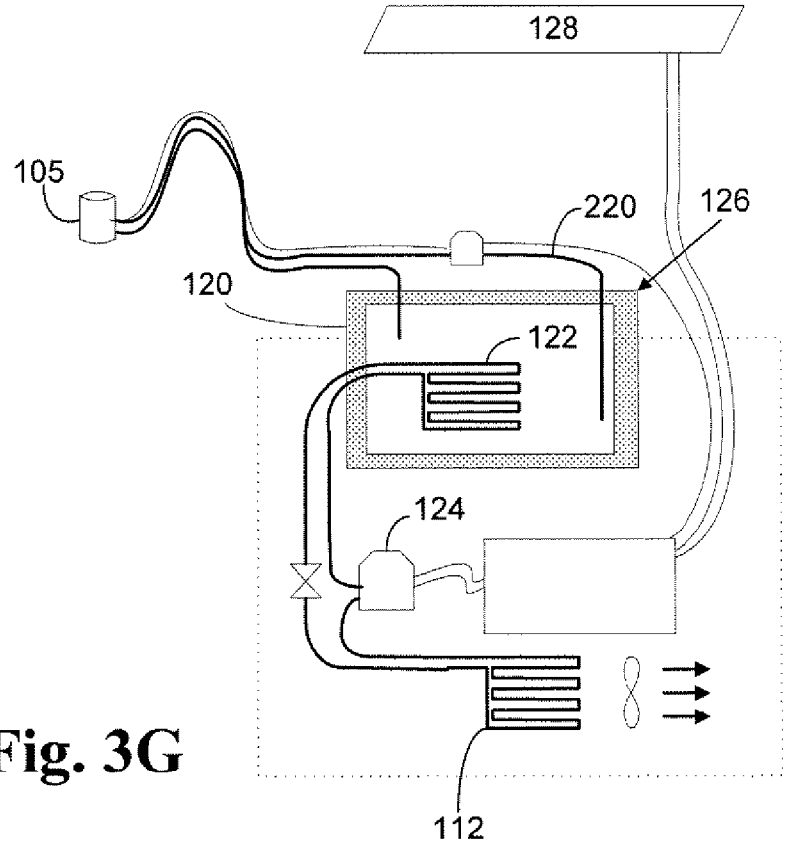
FIG. 3G is a schematic view of the components of the hot and/or cold system 200.
Figure 3H:
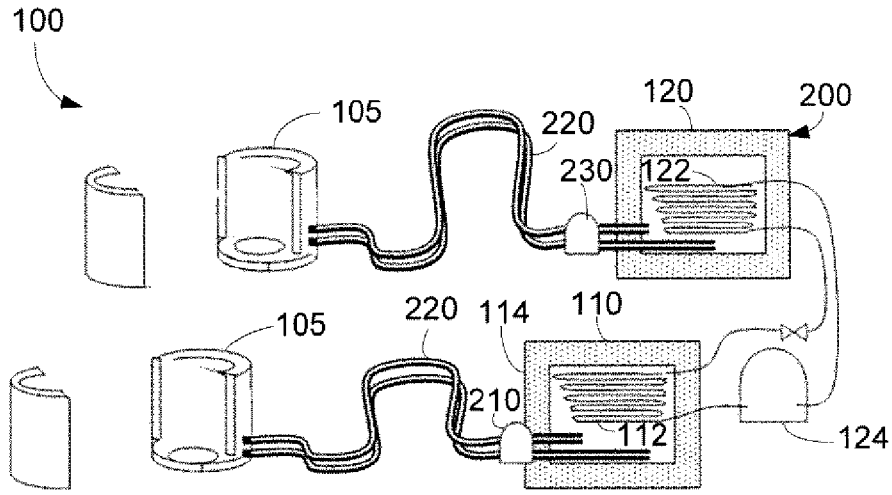
FIG. 3I is a schematic view of the components of the hot and/or cold system 200.
Figure 3I:
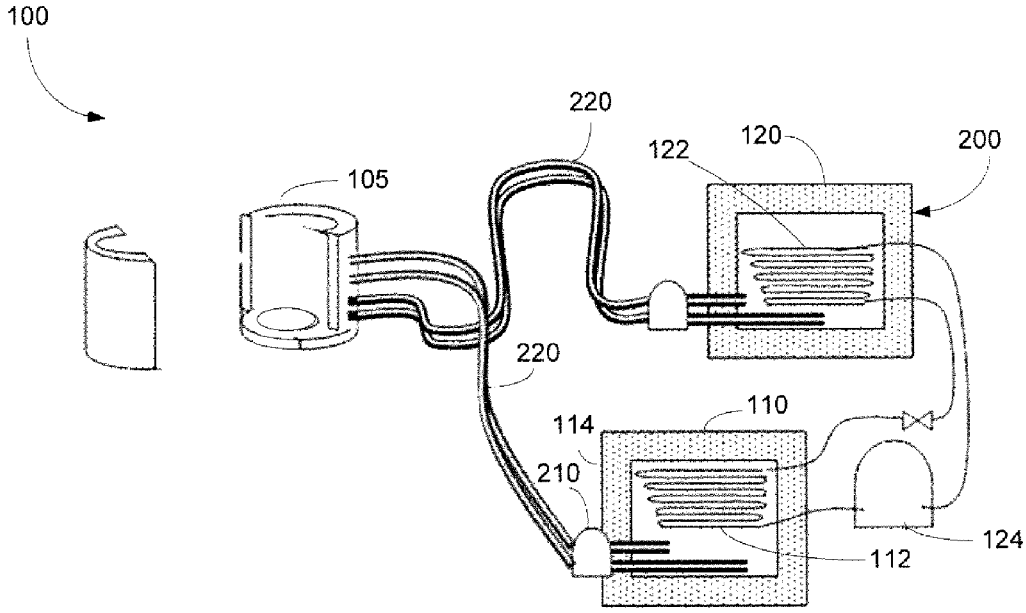

FIGS. 3G-3H show the hot and/or cold system 200 and the hot and/or cold device 100 as a whole in more detail. Specifically, the main refrigerated space 120 may include a heat exchanger 122 and a refrigerator 124. The heat exchanger 122 may be positioned within an insulated enclosure 126. The insulated enclosure 126 may include a eutectic phase change material therein. Likewise, a conventional ice bath or other type of chiller may be used. The heat exchanger 122 exchanges heat with the coolant flowing through the tubing 220. The refrigerator 124 may be the Stirling cooler, the vapor compression device, or other type of cooling means. In FIG. 3G, the heat rejection space 110 is not used. Rather, a second heat exchanger 112 may be used to expel heat to the ambient. In FIGS. 3H (and 3B), the heat rejection space 110 includes the second heat exchanger 112 positioned within a second insulated enclosure 114. The second heat exchanger 112 exchanges heat with the coolant flowing through the tubing 220. The waste heat from the heat exchanger 122 flows through the second heat exchanger 112 before being returned to the refrigerator 124 for the next cycle. FIG. 3H shows the use of multiple clamps 105, one for cooling and one for heating. (FIG. 3B shows the use of a single clamp 105 for heating and cooling.) Note that the refrigerator 124 may be driven from a conventional power source or even via a solar power source 128 given the expected relatively low power demands.

Figure 4A:
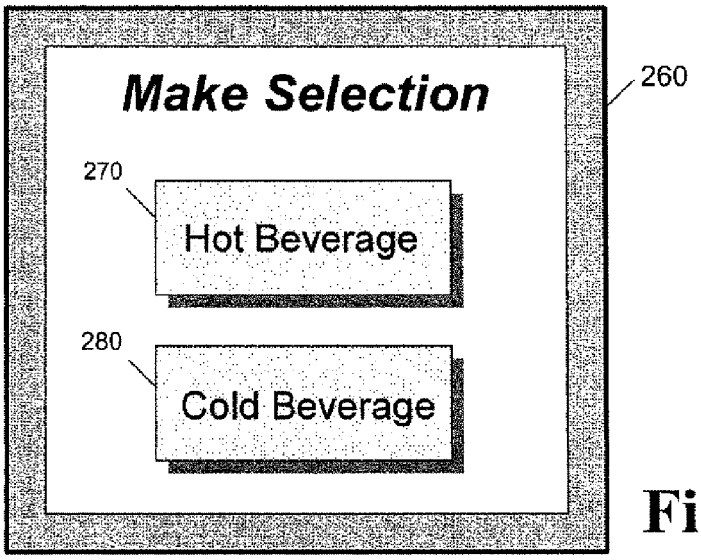
FIG. 4A is a plan view of a consumer interface for allowing hot or cold selections.

FIG. 4A shows one example of a consumer interface 260 for allowing hot or cold selections. The dispensing device 10 may dispense products 50 that can be cooled or heated. In many instances, the type of drink may indicate whether to heat or cool the beverage or other product 50. For example, if a consumer desired a COCA-COLA beverage or other type of product 50, the hot or cold system 200 may automatically cool the beverage or other product 50 to a pre-selected product temperature. If however, a consumer desired a beverage or other product 50 that could be consumed hot or cold based on the consumer's preference, the consumer interface 260 may be used to effectuate the ability for the consumer to choose to heat or cool the product.

The consumer interface 128 may have a button 270 for a hot beverage or other product 50 and a button 280 for a cold beverage or other product 50. The user interface 260 may be located proximate to the dispensing device 10 and may allow the consumer to determine if the clamp 105 containing the consumer's dispensed beverage or other product 50 will heat or cool the beverage or other product 50. The buttons 270, 280 may be membrane switches, switches, and/or other types and kinds of buttons as may be desired.

Figure 4B:
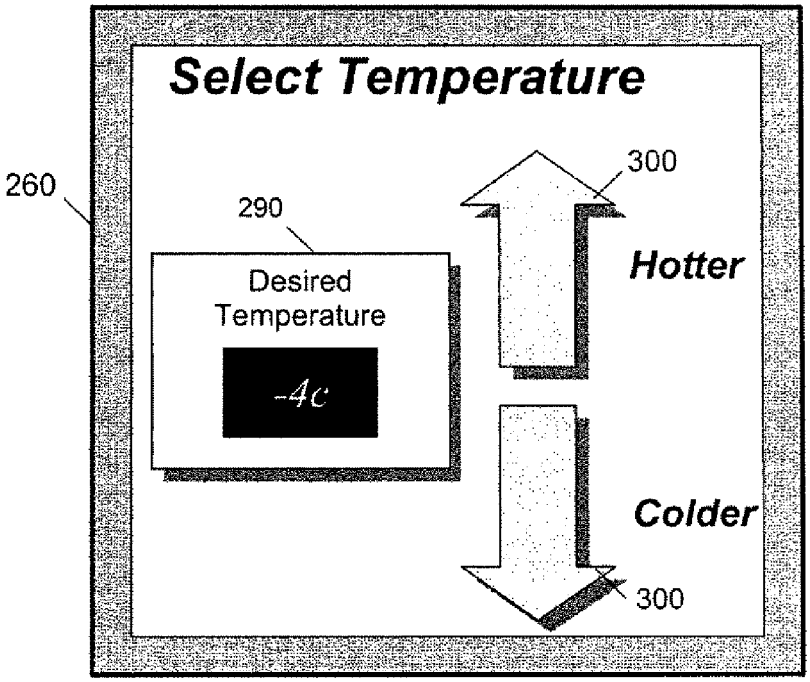
FIG. 4B is a plan view of a consumer interface for allowing selection of a desired product temperature.

FIG. 4B shows one example of the consumer interface 260 for allowing selection of a desired product temperature. The consumer interface 260 may have a display 290 and buttons 300. The consumer may use the buttons 300 to adjust the displayed temperature value, which can represent the desired product temperature. The buttons 300 also may be membrane switches, switches, and/or other types and kinds of buttons as may be desired.

Figure 4C:
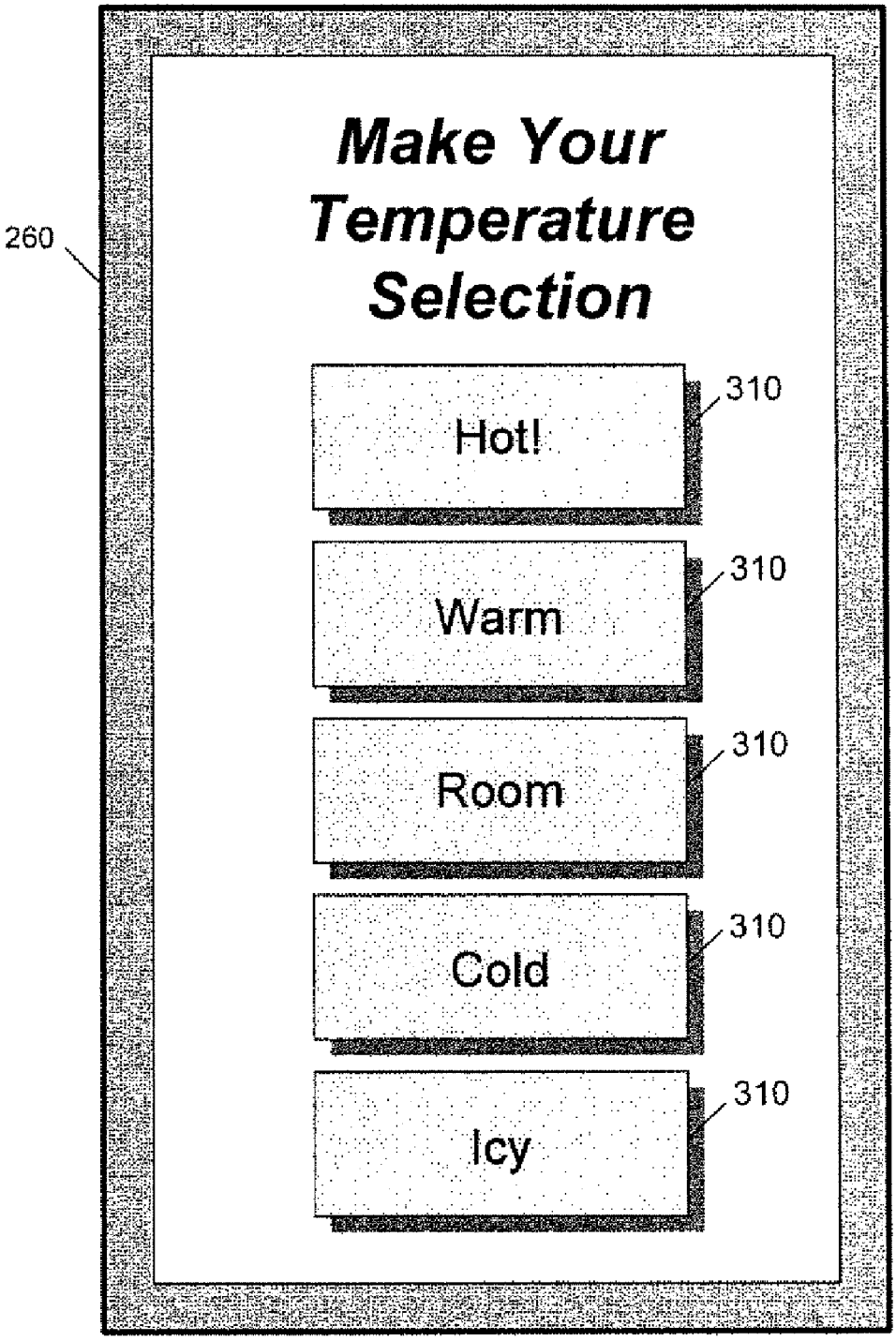
FIG. 4C is a plan view of a consumer interface for allowing selection of a variety of hot or cold product temperatures.

FIG. 4C shows one example of the consumer interface 128 for allowing the selection of a variety of hot or cold product temperatures. A number of buttons 310 may be utilized to effectuate the consumer's ability to select the desired product temperature. In this regard, the buttons 310 may give the consumer a number of choices from hot to icy. Each of the buttons 310 may be preprogrammed to correspond to a certain desired product temperature. When the consumer dispenses a product 50 and the clamp 105 is preparing to heat or cool the product 50, the consumer may select the desired product temperature by pressing one of the buttons 310. The buttons 310 also may be membrane switches, switches, and/or other types and kinds of buttons as may be desired.

Figure 4D:
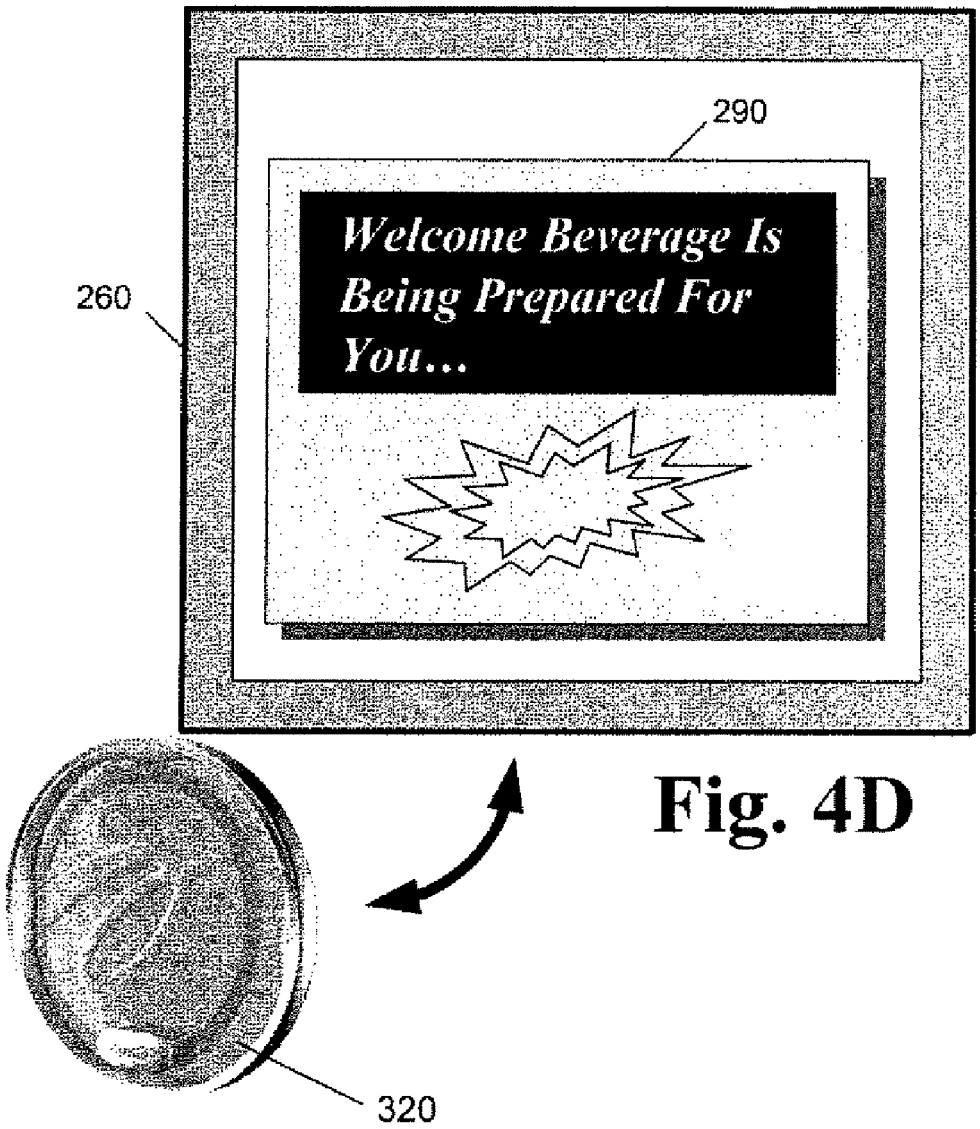
FIG. 4D is a plan view of a consumer interface device being used to effectuate the selection of a product and/or the selection of a desired product temperature.

FIG. 4D shows one example of the consumer interface device 260 being used to effectuate the selection of a product 50 and/or the selection of the desired product temperatures. A wireless consumer interface device 320 may be utilized to effectuate payment and communicate a number of consumer preferences to the dispensing device 10. A consumer may upload and download consumer preference information with the wireless device 320. Such consumer preferences may include the type and kind of product 50 the consumer prefers, the consumer's desired product temperature, a frosting message, other product customizations, and/or other types and kinds of preferences as may be desired. Furthermore, the display 290 may present informative messaging to the consumer as may be desired. In addition, the wireless device 320 may be utilized by the consumer to provide loyalty, stored value, and other types and kinds of account information as necessary to effectuate payment for the dispensed products and/or services. An example of the wireless consumer interface device is shown in, for example, commonly owned U.S. Pat. No. 6,424,884 entitled "Vending Machine with Transponder Interrogator", incorporated herein by reference.

Figure 4E:
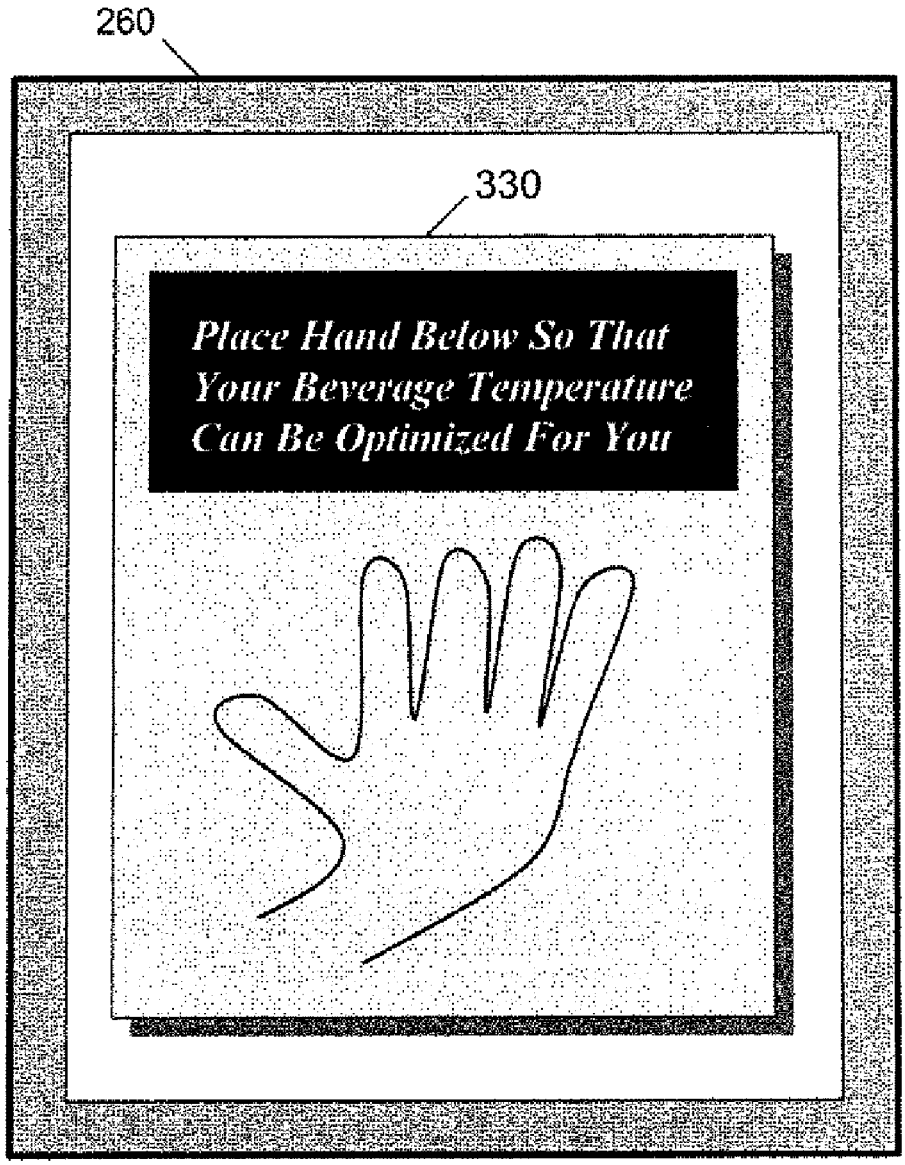
FIG. 4E is a plan view of a consumer interface for allowing a consumer's body temperature to be used as a factor in determining a desired product temperature.

FIG. 4E shows one example of the consumer interface 260 for allowing the consumer's body temperature to be used in part as a factor in determining the desired product temperature. In this regard, a consumer may place a hand or other body part in proximity to a consumer interface touch point 330. The consumer's temperature, hydration level, and/or other biometric conditions may be determined. Such determinations may then be utilized in part in the determination of the desired product temperature and/or in the selection of the appropriate product 50 to dispense so as to satisfy the consumer's current conditions. Many different types of monitoring equipment for body temperature, heart rate, blood pressure, and other bodily functions are known.

Figure 4F:
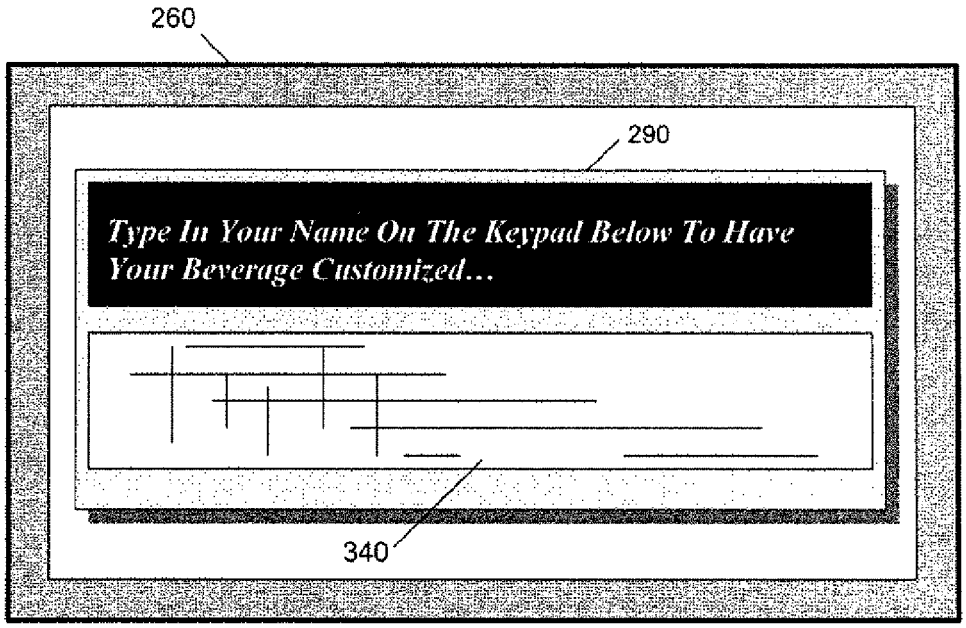
FIG. 4F is a plan view of a consumer viewable display and keypad.

FIG. 4F shows one example of a hot and/or cold device 100 having the consumer viewable display 290 and a keypad 340. A consumer can, by way of the consumer interface 260, customize a product 50 by electing to frost the product packaging. The consumer may elect to customize the product 50 by entering text and/or graphic indicia on the keypad 340. The text and/or graphic indicia may then be frosted onto the packaging material for the beverage or other product 50. Such text and/or graphic indicia also may be data communicated by way of the wireless device 320 as part of the consumer's preferences. The entire product 50 may be misted with frost and the text and/or graphic indicia may be etched in with a stylus or a similar type of device. Alternatively, the text and/or graphic indicia may be pretreated via ink jet, pen deposition, and the like. The product 50 may then be misted such that frost forms around but not on the pretreated text and/or graphic indicia. Other frosting methods may be used herein.

Figure 5:
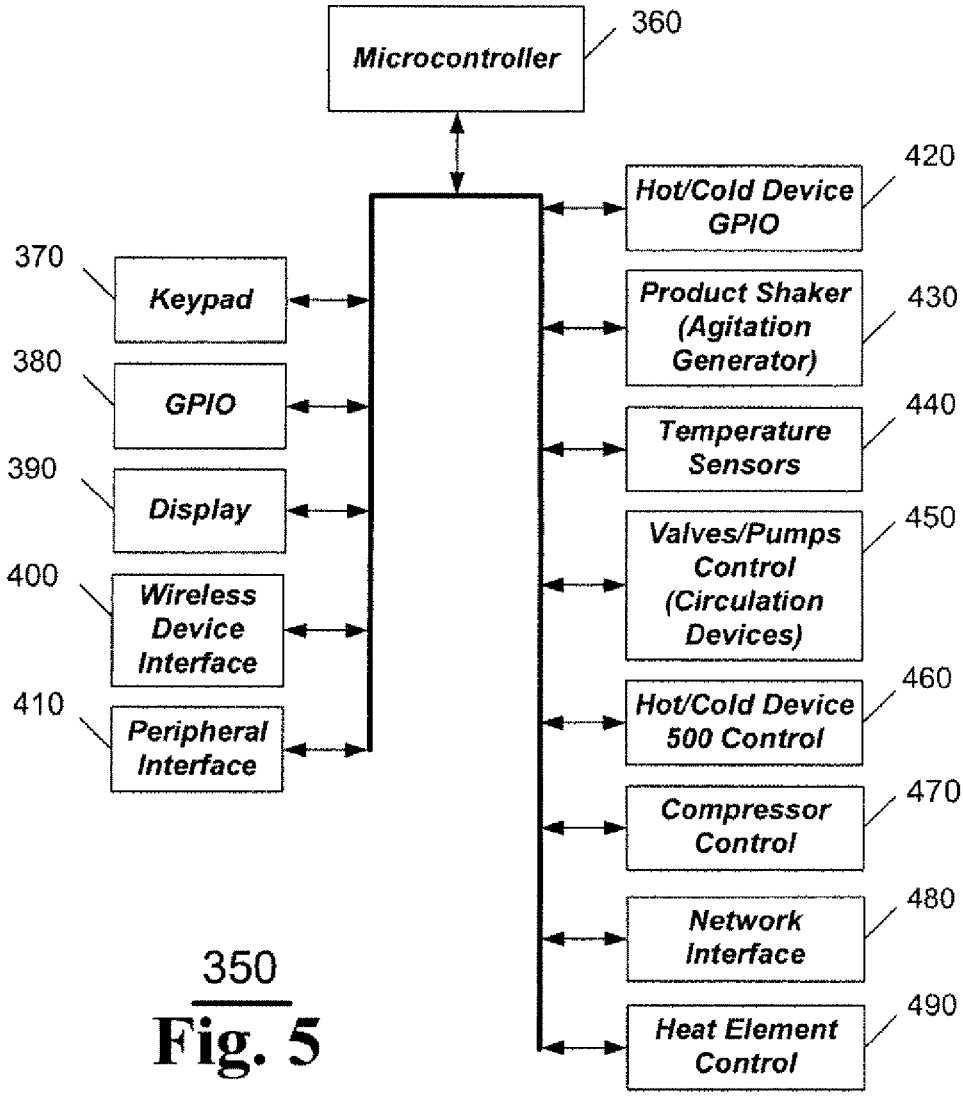
FIG. 5 is a schematic view of a control system of a hot and/or cold device.

FIG. 5 shows one example of a control system 350 for the hot and/or cold device 100. The control system 600 may be used to control the hot and/or cold device 100 (the clamp 105) and the various cooling and heat systems. The control system 350 may enable a consumer can make a product selection, control the heating or cooling of the product 50, effectuate the dispensing of the product 50 at the desired product temperature, and/or otherwise monitor and/or control other aspects of the system 100 as a whole. In addition, product shakers, sensors, and/or network interfaces may be utilized as will be described in more detail below.

The control system 350 may include a microcontroller 360. The microcontroller 360 may be an Intel, Motorola, Microchip, and/or other types and kinds of controller device. Interconnected with the microcontroller 360 may be a keypad 370, general purpose inputs and outputs (GPIO) 380, a display 390, a wireless device interface 400, and a peripheral interface 410. The keypad 370 may be a keyboard, push buttons, switches, membrane switches, and/or other types and kinds of keypads as may be desired. The GPIO 380 may include buttons, switches, sensors, readers, relays, lights, light emitting diodes, and/or other types and kinds of GPIO's and/or GPIO activated devices as may be desired. The display 390 may be a liquid crystal display (LCD), a light emitting diode (LED), a vacuum florescent display (VFD), and/or other types and kinds of displays as may be desired. The wireless device interface 400 may be a radio frequency identification device (RFID), infrared (IRDA) optical communication system, a wireless data processing device, and/or other types and kinds of wireless device interfaces as may be desired. The peripheral interface 410 may include a multi-drop bus (MDB), a data exchange interface (DEX), a bill acceptor, a coin acceptor, a cashless reader, and/or other types and kinds of peripherals as may be desired.

Interconnected with the microcontroller 360 may be hot/cold general purpose inputs and outputs GPIO 420, a product shaker 430, temperature sensors 440, a valve/pump control 450, a hot/cold device 100 control 460, a compressor control 470, a network interface 480, a heat element control 490, and other devices. The hot/cold GPIO 420 may be utilized to control fans, lighting, and/or other GPIO devices as may be desired.

The product shaker 430 may utilize ultrasound and/or other types and kinds of high frequency techniques to induce agitation that speeds the cooling or heating of the product 50. Inducing ultrasound or other high frequency signals into the contents of the beverage or other product 50 may induce the transmission of coldness or heat resultant from by agitation of the contents of the beverage or product 50. Such agitation may promote the acceleration of heating or cooling as well as promoting a more even distribution of hot and cold throughout the product contents. The use of ultrasound and/or other high frequency signals offers certain advantages such as being able to better agitate the contents of the beverage or other products 50 in firm wall vessels. Firm wall vessels, such as contoured aluminum bottles, aluminum cans, and glass may be difficult to agitate without causing the carbonated contents of the beverage or other product 50 to be expelled when the product 50 is opened. Ultrasound and/or other high frequency signals allows agitation of the beverage or other product 50 in controlled amounts to promote the heating or cooling of the product contents while minimizing the possibly explosive effects encountered when a carbonated beverage or other product 50 is over shaken prior to opening.

Similar agitation during cooling is common practice in beverage fountain machines. The agitation enhances uniform temperatures and improves heat transfer. Accessing the interior of a packaged beverage for agitation introduces additional sanitary concerns. Exterior agitation avoids such concerns. Other types of shakers 430 may include rotation of the product 50, spinning of the product 50, linear oscillation of the product 50, and/or other types and kinds of shakers 430 as may be desired.

Other embodiments include agitation to enhance the heat transfer to beverages inside the package. Agitation may be provided with ultrasonic waves, mechanical vibration, mechanical oscillating rotation or mechanical oscillating translation in any direction. Agitation may also be achieved by mechanically coupling the heat exchanger 107 to the pump 230 such that vibration from the pump activation can be transferred to the product 50. Agitation may also be achieved by designing chambers inside the product heat exchanger 107 that expand to various shapes depending on the fluid flow rate. The change in shape would cause the product 50 to move providing sufficient agitation.

The temperature sensors 440 may be utilized to determine ambient conditions, product conditions, temperature of the main refrigerated space 120, the heat rejection space 110, and/or other types and kinds of temperature sensing as may be desired. An infrared (IRDA) temperature sensing technique may be used to determine the temperature of the product contents. Such product contents temperature determination may then be used in part to determine when the product contents are at the desired product temperature and/or how much longer will it take to obtain the desired product temperature.

The valves/pumps control 450 may be utilized to control the circulation of cooled liquids and/or gases through system 200. The valves and the pumps such as valves/pumps 210 may be controlled so as to allow and deny the circulation of liquids and/or gases responsive to the program executions of the microcontroller 360. The Hot/cold device control 460 may be utilized to control the mechanical, fluid, and electrical actions and systems of the hot/cold device 100. The compressor control 460 may be utilized to monitor and control a compressor, optimize compress operation, and/or provide other types and kinds of compressor control as may be desired. The heat elements and controls 490 may be utilized to monitor and/or control the heat rejection system.

The network interface 480 may be utilized to effectuate data communication with a data processing resource, data processing devices, databases, and/or other types and kinds of data processing equipment as may be desired. Such data communication may be effectuated for the purposes of monitoring the controlling system 350, monitoring/controlling the dispensing device 10, data communication related to consumer preferences, data communication related to effectuating payment for goods and/or services, and/or for other purposes as may be desired.

The control system 350 illustrated in FIG. 5 may be manufactured with less than all the features illustrated herein when desired and/or required in a particular embodiment. For example, if the heat element control 490 is not required in an embodiment then the feature may be excluded from the manufacture of control system 350. In general, cost requirements and/or design requirements can be utilized to fine tune the features and benefits of a system 350.

Figure 6A:
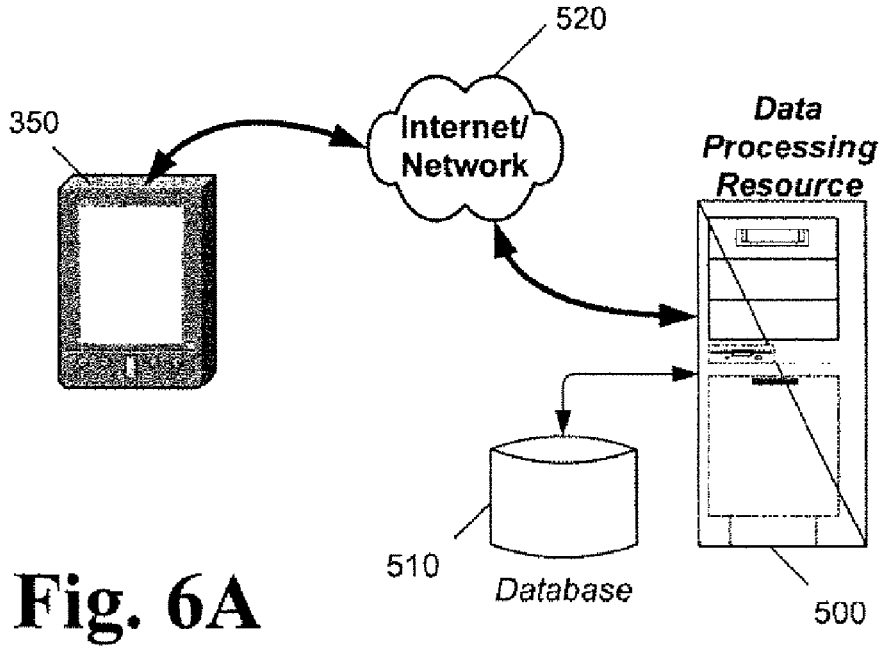
FIG. 6A is a schematic view of a control system networked to a data processing resource and a database.
Figure 6B:
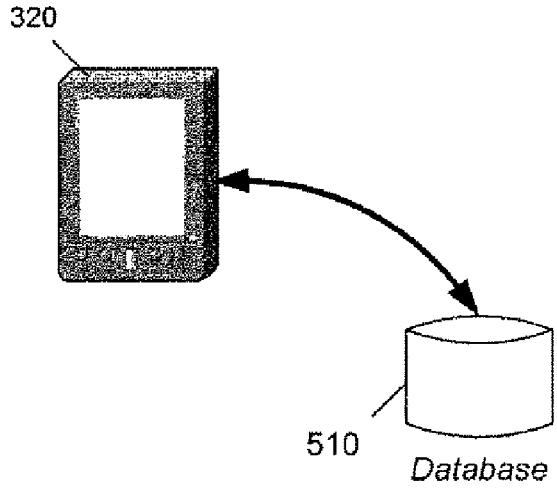
FIG. 6B is a schematic view of a control system networked to a database.

FIG. 6A shows one example of a control system 350 networked to a data processing resource 500 and a database 510. The control system 600 may be networked by way of an internet/network 520 to the data processing resource 500. The system 350 may communicate control, monitoring, payment, consumer preferences, and/or other types and kinds of data between the system 350, the data processing resource 500, and/or the database 510. Such data communication may be over the internet, local area network (LAN), and/or wide area network (WAN). The internet, LAN, WAN, internet/network 530, and other network references may be referred to as a global network and data processing resource 500 may be referred to as a global network based data processing resource. FIG. 6B shows one example of a control system 350 networked to the database 510. Equipment configuration, consumer preferences, and/or other types and kinds of data can be data communicated between the system 350 and/or stored in the database 510.

Figure 7:
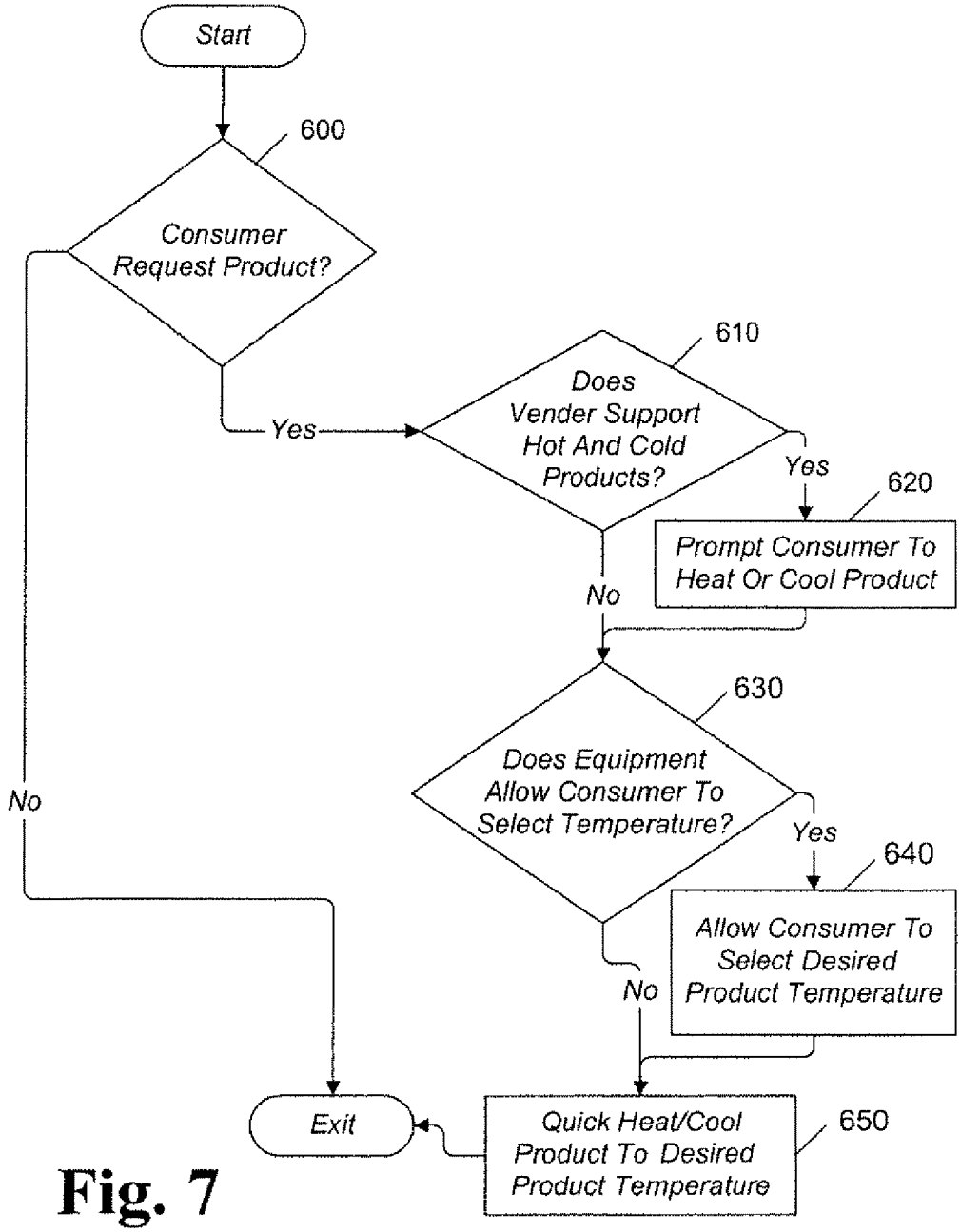
FIG. 7 is a flow chart of method steps for a consumer selecting a product and the product being heated or cooled.

FIG. 7 shows one example of a consumer selecting a product 50 and the product 50 being heated or cooled to the desired product temperature. A consumer may dispense a product 50 and the product 50 may be held by the hot and/or cold device 100. Cold liquid or gases, in the temperature range of −40 degrees Celsius or otherwise, may be cooled within the main refrigerated space 120 and then circulated through the clamp 105 so as to cool the held product 50 to the desired product temperature. Alternatively, the product 50 may be heated. Hot liquid and/or gases, in the temperature range of +90 degrees Celsius or otherwise, may be heated within the heat rejection space 110 and then circulated through the clamp 105 so as to heat the held beverage or other product 50 to the desire product temperature.

In decision block 600, a determination is made as to whether a consumer has requested a product 50. If the result is in the affirmative then processing moves to decision block 610. If the result is in the negative then the routine is exited. In decision block 610 a determination is made as to whether the vender 20 supports hot and cold beverages or other products 50. If the result is in the affirmative then processing moves to block 620. If the result is in the negative then processing moves to decision block 630. In block 620, a prompt is made to inform the consumer and have the consumer indicate whether heating or cooling of the product 50 is desirable. In decision block 630, a determination is made as to whether the consumer is allowed to adjust the product temperature. If the result is in the affirmative then processing moves to block 640. If the result is in the negative then processing moves to block 650. In block 640, the consumer is allowed to select or otherwise adjust the product temperature. In block 650, the product 50 is quickly heated or cooled by way of the clamp 105 to the desired product temperature. The routine is then exited.

Figure 8:
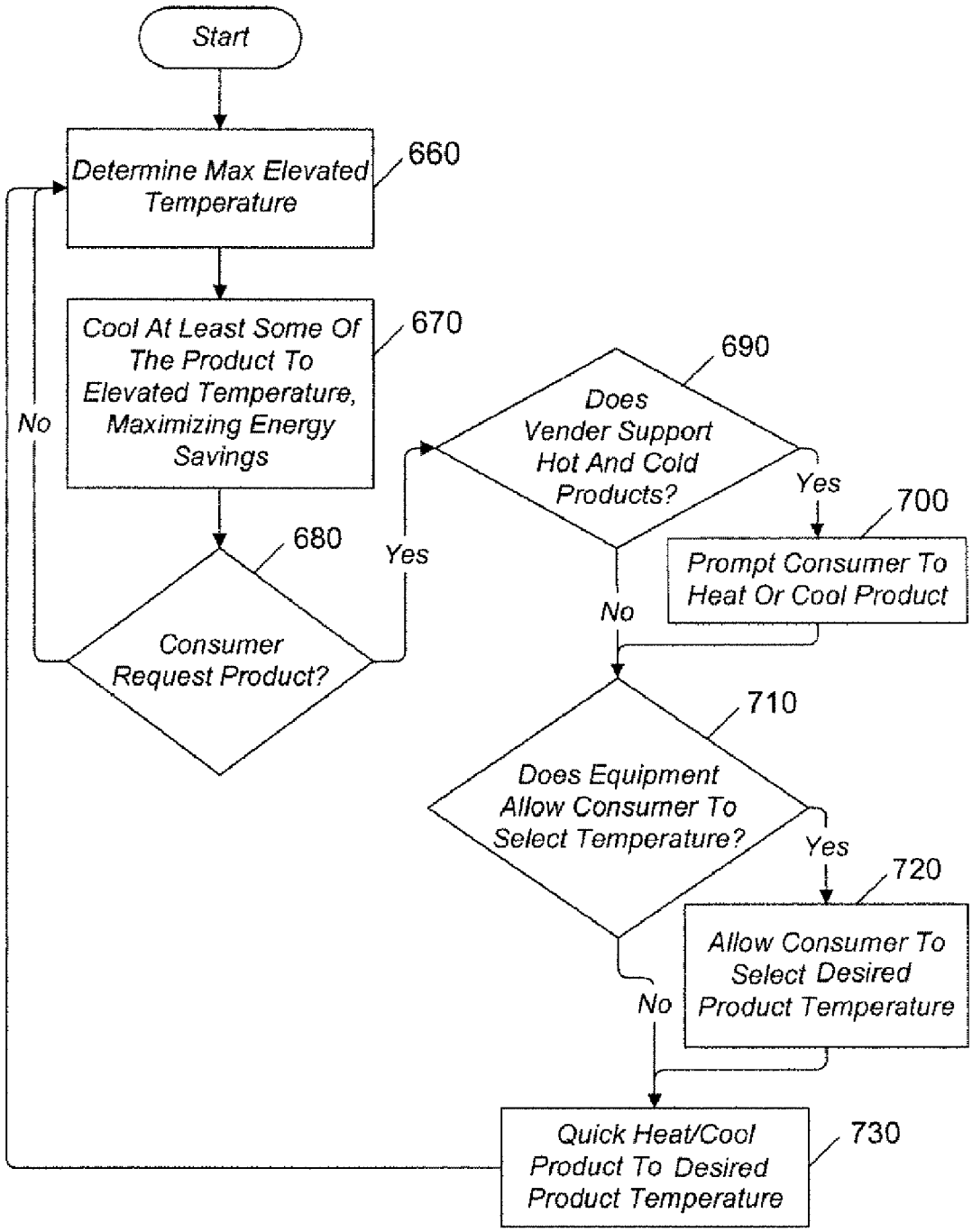
FIG. 8 is a flow chart of method steps for vending a product refrigerated to an elevated temperature, the consumer selecting the product, and the product being heated or cooled.

FIG. 8 shows one example of a method of vending a product 50 refrigerated to an elevated temperature to maximize energy savings, and then after the consumer selects the product, the product 50 is heated or cooled to the desired product temperature. A maximum elevated temperature may be selected to protect the product 50 from overheat conditions, as can happen in direct sunlight. The maximum elevated temperature is the temperature at which the product storage area 240 should not exceed. The maximum elevated temperature also may be selected so as to cool or heat a product 50 in a certain amount of time. For example, if the temperature rate of change is one degree per second and the maximum cool and/or heat time is to be twenty (20) seconds, then the maximum elevated temperature may be determined and the product storage area 240 may be maintained at that temperature.

An advantage of only cooling the product 50 to the maximum elevated temperature (or refrigerated to an elevated temperature) in the product storage area 240 and then adjusting the product temperature to the desired product temperature when selected by a consumer is that energy savings may be realized. Allowing the maximum elevated temperature to be in the range of room temperature also protects the product 50 from overheating. As such, being able to adjust the product to the desired product temperature in seconds maximizes energy savings while dispensing quality beverages or other product 50 to consumers.

In block 660, a maximum elevated temperature may be determined. The product storage area 240 may be maintained so as not to exceed the maximum elevated temperature. In block 670, at least some of the products 50 located in the product storage area 240 are cooled to the maximum elevated temperature so as to maximize energy savings. In decision block 680, a determination is made as to whether a consumer has requested a product 50. If the result is in the affirmative, then processing moves to decision block 690. If the result is in the negative then processing returns to block 660. In decision block 690, a determination is made as to whether the vender 20 supports hot and cold beverages. If the result is in the affirmative then processing moves to block 700. If the result is in the negative then processing moves to decision block 710. In block 700, a prompt is made to inform the consumer and have the consumer indicate whether heating or cooling of the product 50 is desirable. In decision block 710, a determination is made as to whether the consumer is allowed to adjust the product temperature. If the result is in the affirmative then processing moves to block 720. If the result is in the negative then processing moves to block 730. In block 720, the consumer is allowed to select or otherwise adjust the product temperature. In block 730, the product 50 is quickly heated or cooled by way of the clamp 105 to the desired product temperature. Processing then returns to block 660.

Figure 9:
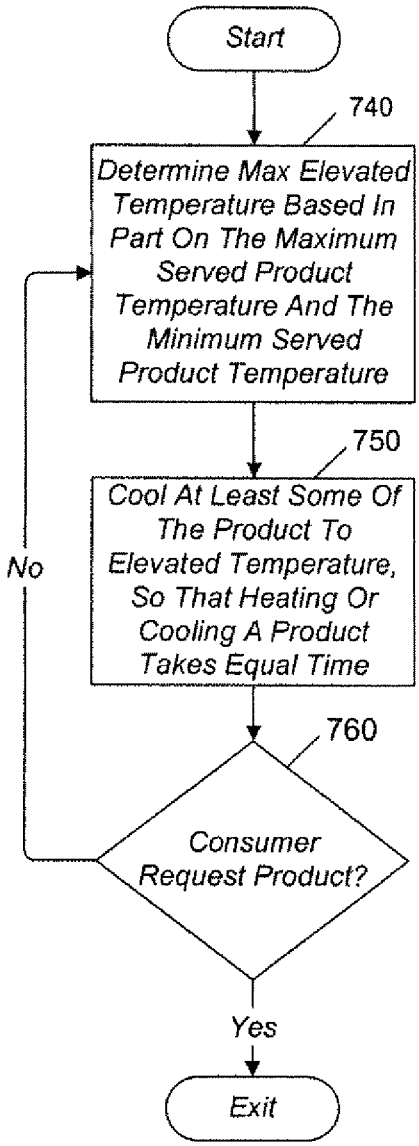
FIG. 9 is a flow chart of method steps for determining the amount of heating or cooling time to obtain the desired product temperature.

FIG. 9 shows one example of a method of vending a product 50 refrigerated to an elevated temperature to minimize the amount of heating or cooling time to obtain the desired product temperature. When the products 50 share the same product storage area 240, the refrigerated elevated temperature may be selected such that the amount of time to heat or cool to the desired product temperature may be equalized. A refrigerated elevated temperature that is equally distance, from a rate of change perspective, to the desired product temperatures (hot and cold) may be selected by determining the rate of temperature change for heating the products 50 and for cooling the products 50. In operation, this can allow heated beverages and other products 50 and cooled beverages and other products 50 to reach the desired product temperature in about the same amount of time.

In block 740, a maximum elevated temperature is determined based in part on the maximum serving temperature of the hot beverage or other product 50 (the hot optimum product temperature) and the minimum serving temperature of the cold beverage or other product 50 (the cold optimum product temperature). In block 750, at least some of the products 50 are cooled to the maximum elevated temperature such that heating or cooling the product 50 by way of the hot and/or cold device 105 can be done in the same amount of time. In decision block 760, a determination is made as to whether a consumer has requested a product 50. If the result is in the affirmative then the routine is exited. If the result is in the negative then processing returns to block 740.

Figure 10:
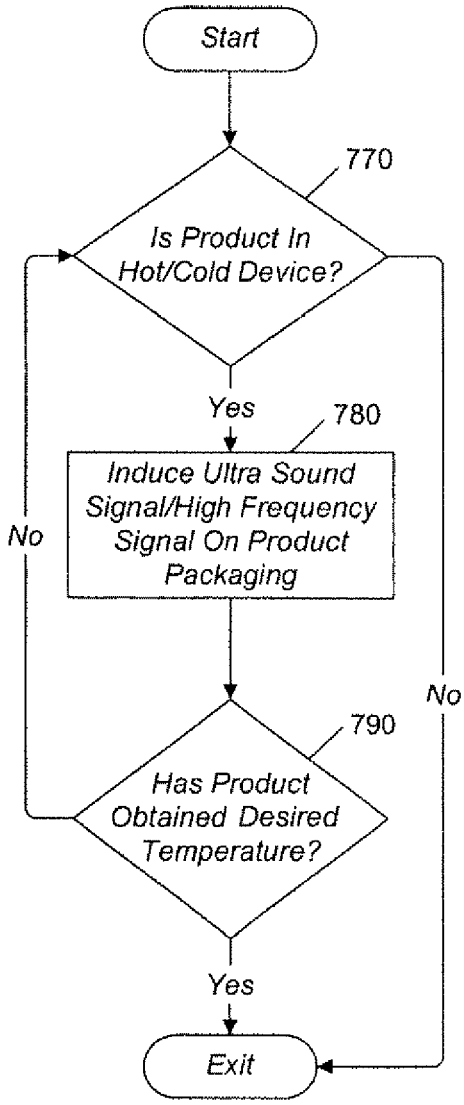
FIG. 10 is a flow chart of method steps for using ultrasound and/or high frequency signals to cause the contents of a beverage or other product to be agitated to induce quicker heating or cooling of the contents.

FIG. 10 shows one example of a method of using ultrasound and/or high frequency signals to cause the contents of the beverage or other product 50 to be agitated so as to induce quicker heating or cooling. The contents of the beverage or other product 50 may be agitated such that as the surface temperature at the packaging barrier walls of the beverage or other product 50 is adjusted towards the desired product temperature, the contents of the beverage or other product 50 are mixed so as to stir the contents and cause substantially even temperature distribution. In firm wall containers for the beverage or other products 50, such as aluminum, aluminum contoured bottles, and glass, agitating the contents of the beverage or other product 50 may be difficult. In addition, over shaking a carbonated beverage or other products 50 may cause excessive foaming, spilling, explosive egress, and/or other undesirable consequences. As such, providing ultrasound and/or high frequency signals at the barrier walls to induce agitation of the contents may promote even and quick distribution of temperature throughout.

In decision block 770, a determination is made as to whether there is a beverage or other product 50 in the hot and/or cold device 100 waiting to be heated or cooled. If the result is in the affirmative then processing moves to block 780. If the result is in the negative then the routine is exited. In block, 780 ultrasound and/or high frequency signals are induced into the contents of the beverage or other product 50 by way of the packaging walls so as to agitate the contents and promote substantially even temperature distribution throughout the contents. In decision block 790, a determination is made as to whether the beverage or other product 50 has obtained the desired product temperature. If the result is in the affirmative then the routine is exited. If the result is in the negative then processing returns to decision block 770.

Figure 11:
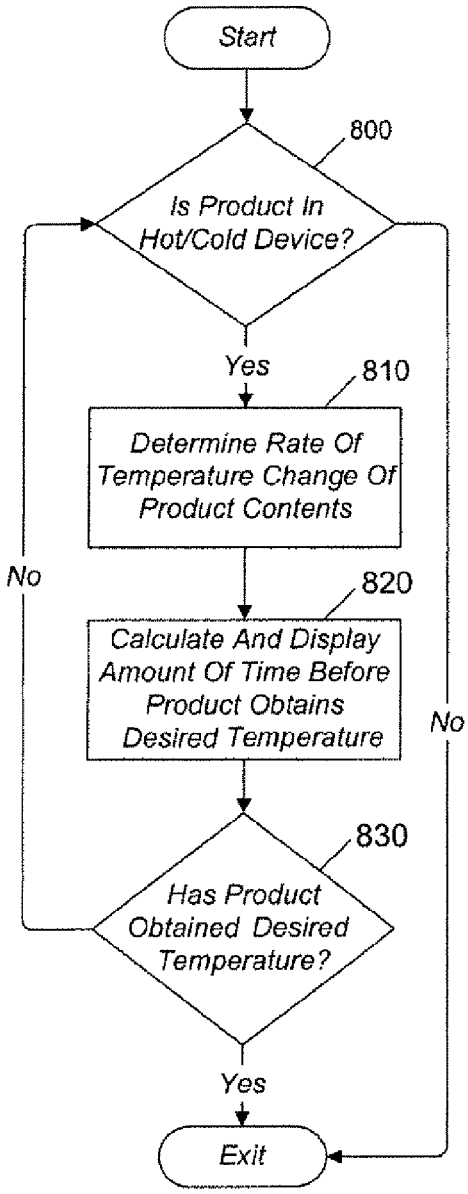
FIG. 11 is a flow chart of method steps for determining the rate of temperature change of the contents of a beverage or other product, calculating the time until the product temperature is obtained, and displaying the time remaining.

FIG. 11 shows one example of a method of determining the rate of temperature change of the contents of beverages or other products 50, calculating the time until the desired product temperature is obtained, and displaying the time remaining. The consumer thus can be informed when the product temperature has been adjusted to the desired product temperature. As such, the rate of change of the product temperature is monitored and the amount of time remaining is determined.

In decision block 800, a determination is made as to whether there is a beverage or other product 50 in the hot and/or cold device 100 to be heated or cooled. If the result is in the affirmative then processing moves to block 810. If the result is in the negative then the routine is exited. In block 810, the rate of temperature change of the contents of the beverage or other product 50 may be determined. In block 820, the amount of time remaining before the desired product temperature is obtained is calculated and optionally displayed. In decision block 830, a determination is made as to whether the beverage or other product 50 has obtained the desired product temperature. If the result is in the affirmative then the routine is exited. If the result is in the negative then processing returns to decision block 800.

Figure 12:
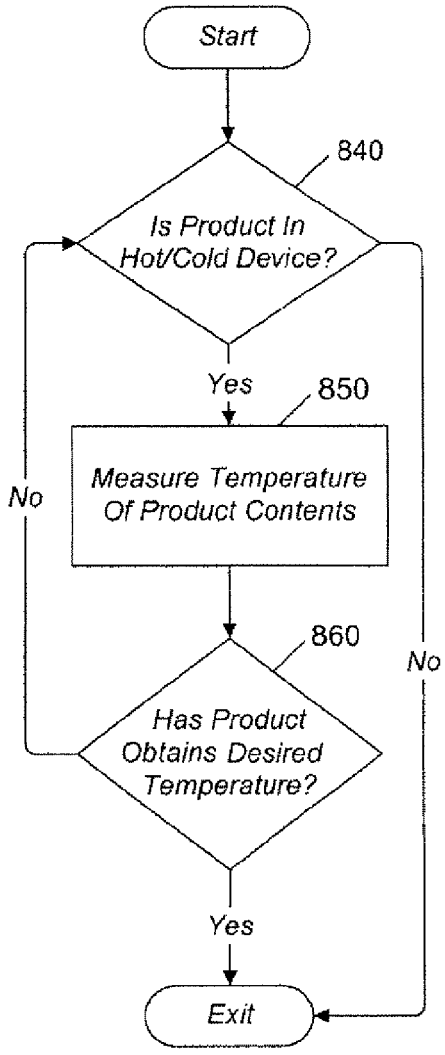
FIG. 12 is a flow chart of method steps for measuring the temperature of the contents of a beverage or other product.

FIG. 12 shows one example of a method of measuring the temperature of the contents of the beverage or other product 50. The temperature of the contents of the beverage or other product 50 may be measured and a determination may be made as to when the contents have obtained the desired product temperature.

In decision block 840, a determination may be made as to whether there is a beverage or other product 50 in the hot and/or cold device 100 that is to be heated or cooled. If the result is in the affirmative then processing moves to block 850. If the result is in the negative then the routine is exited. In block 850, the temperature of the contents of the beverage or other product 50 may be measured. For example, the temperature of the contents may be determined by way of infrared (IRDA) measurement techniques and/or by other techniques as may be desired. In decision block 860, a determination is made as to whether the beverage or other product 50 has obtained the desired product temperature. If the result is in the affirmative then the routine is exited. If the result is in the negative then processing returns to decision block 840.

Figure 13:
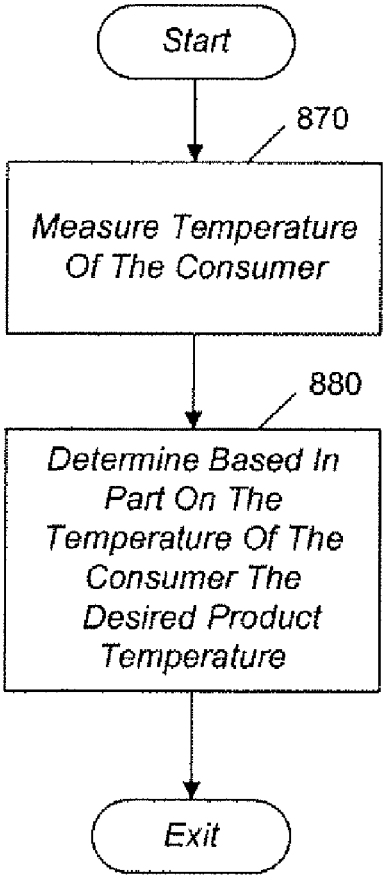
FIG. 13 is a flow chart of method steps for taking the temperature of a consumer and then selecting the desired hot or cold product temperature.

FIG. 13 shows one example of a method of taking the temperature of a consumer and then selecting the desired hot or cold product temperature. A consumer may place a hand or other body part in proximity to a consumer interface touch point 330. The consumer's temperature, hydration level, and/or other conditions may be determined. Such determinations then may be utilized in the determination of the desired product temperature and/or in the selection of the appropriate product 50 to dispense to satisfy the consumer's current conditions. In block 870, the consumer's temperature is measured. In block 880, the desired product temperature may be determined based in part on the temperature of the consumer. The routine is then exited.

Figure 14:
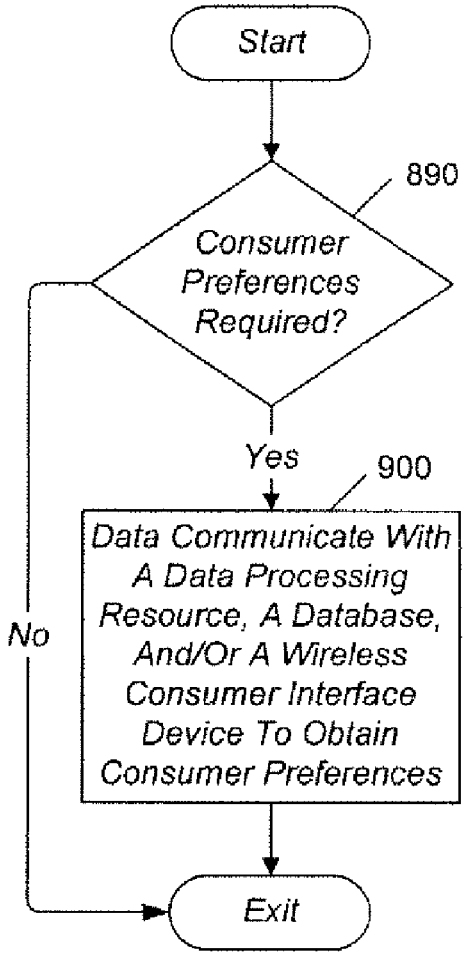
FIG. 14 is a flow chart of method steps for communicating with a data processing resource and/or database to obtain consumer preferences.

FIG. 14 shows one example of a method of communicating with a data processing resource 500 and/or database 510 to obtain consumer preferences. Specifically, a consumer may be identified for the purpose of obtaining consumer preferences from a data processing resource 500, a database 510, and/or from a wireless consumer interface device 320. Such consumer preferences then may be used in the selection and/or preparation of the product 50. Such selection and/or preparation data may include, for example, product type, desired product temperature, frosting text, graphic indicia, and/or other types and kinds consumer preference data as may be desired.

In decision block 890, a determination may be made as to whether consumer preferences are required. If the result is in the affirmative then processing moves to block 900. If the result is in the negative then the routine is exited. In block 900, data communication with a data processing resource 500, a database 510, and/or a wireless consumer interface device 320 may be effectuated to obtain and/or save the consumer preferences. The routine is then exited.

Figure 15:
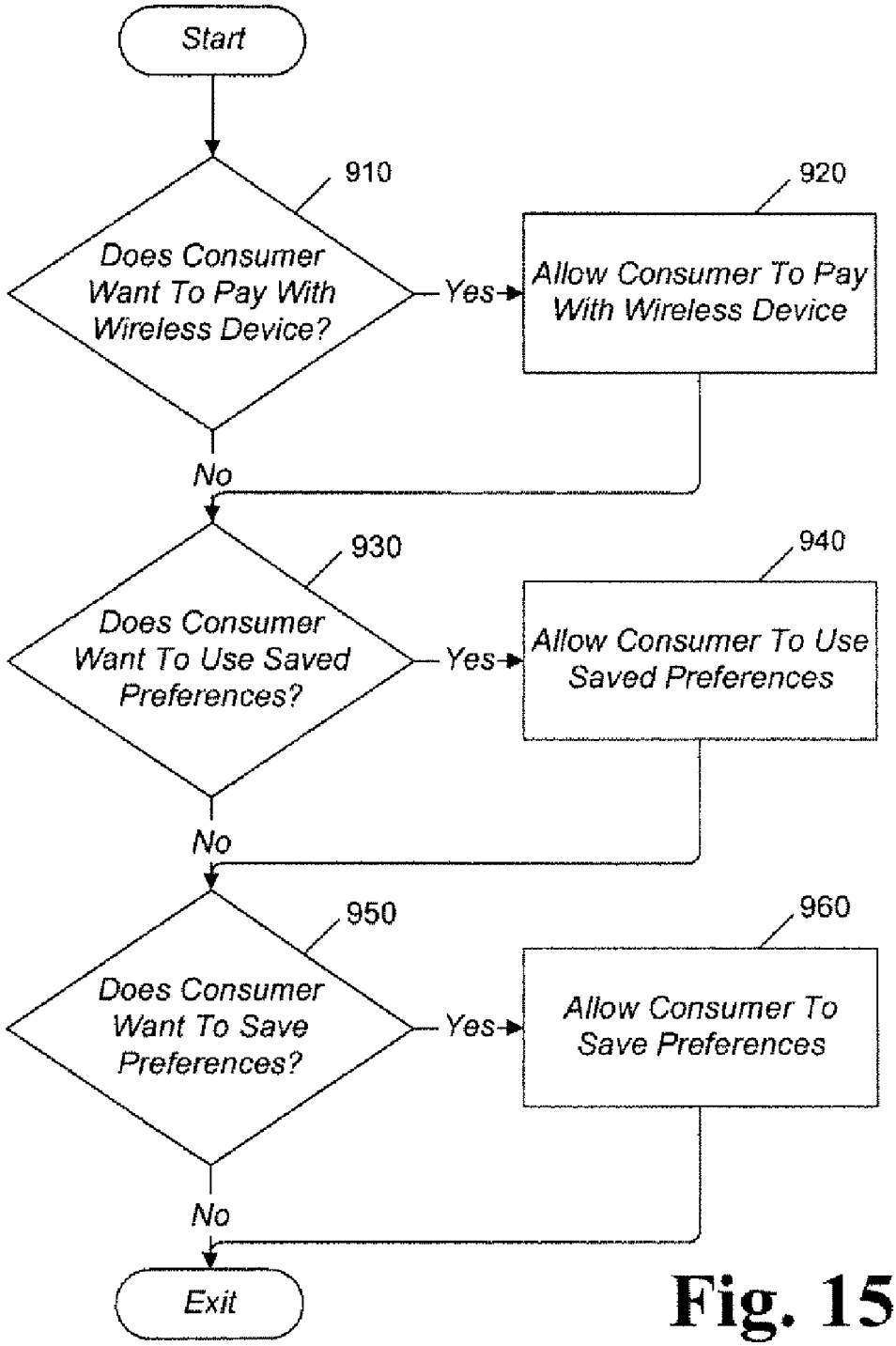
FIG. 15 is a flow chart of method steps for using a wireless consumer interface device to effectuate data communication of consumer preferences and/or payment information.

FIG. 15 shows one example of a method of using a wireless consumer interface device 260 to effectuate data communication of consumer preferences and/or payment information. Specifically, a wireless consumer interface device 320 may be utilized to effectuate payment and communicate a number of consumer preferences to the dispensing device 10 by way of the consumer interface 260. A consumer may upload and download consumer preferences with the wireless device 320. Such consumer preferences may include the type and kind of products 50 the consumer may like, the consumer's desired product temperature, frosting messages or other types of product customizations, and/or other types and kinds of preferences as may be desired. In addition, should payment be required, the wireless device 320 may be utilized by the consumer to provide loyalty, stored value, and other types and kinds of account information necessary to effectuate payment for the dispensed product 50.

In decision block 910, a determination is made as to whether the consumer wants to pay with the wireless device 320. If the result is in the affirmative then processing moves to block 920. If the result is in the negative then processing moves to decision block 930. In block 920, data communication with the wireless device 320 effectuates consumer payment for goods and/or services from the dispensing device 10. In decision block 930, a determination is made as to whether the consumer wants to use the saved consumer preferences, settings, and/or other data located on or accessible by the wireless device 320. If the result is in the affirmative then processing moves to block 940. If the result is in the negative then processing moves to decision block 950. In block 940, consumer preferences, settings, and/or other saved data may be used by the consumer. In addition, such consumer preferences, settings, and/or data may be data communicated by the wireless device 320 to and/or retrieved from the data processing resource 500 and/or the database 510 as may be desired. In decision block 950, a determination is made as to whether the consumer wants to save the consumer preferences, settings, and/or other data to the wireless device 320. If the result is in the affirmative then processing moves to block 960. If the result is in the negative then the routine is exited. In block 960, the consumer preferences, settings, and/or other data may be saved to the wireless device 320. In addition, such consumer preferences, settings, and/or data may be data communicated by way of wireless device 320 to the data processing resource 500 and/or the database 510 and saved as may be desired. The routine is then exited.

Figure 16:
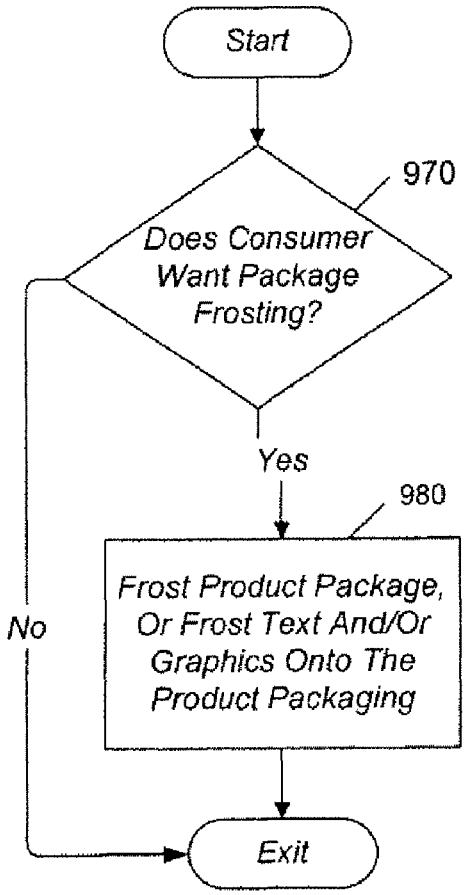
FIG. 16 is a flow chart of method steps for allowing a consumer to frost the package of a beverage or other product or enter text and/or graphics that are then frosted onto the package.

FIG. 16 shows one example of a method for allowing a consumer to frost the package of the beverage or other product 50 or enter text and/or graphics that are then frosted onto the package. Specifically, a consumer may elect to have the product 50 frosted during the temperature adjust to the desired product temperature. The entire package 50 may be frosted or consumer supplied text and/or other graphic indicia may be frosted onto the packaging.

In decision block 970, a determination is made as to whether the consumer wants to frost the product packaging. If the result is in the affirmative then processing moves to block 980. If the result is in the negative then the routine is exited. In block 980, the product packaging may be frosted. In this regard, the entire package may be frosted or consumer supplied text and/or other graphic indicia may be frosted onto the packaging material. The routine is then exited.

Figure 17:
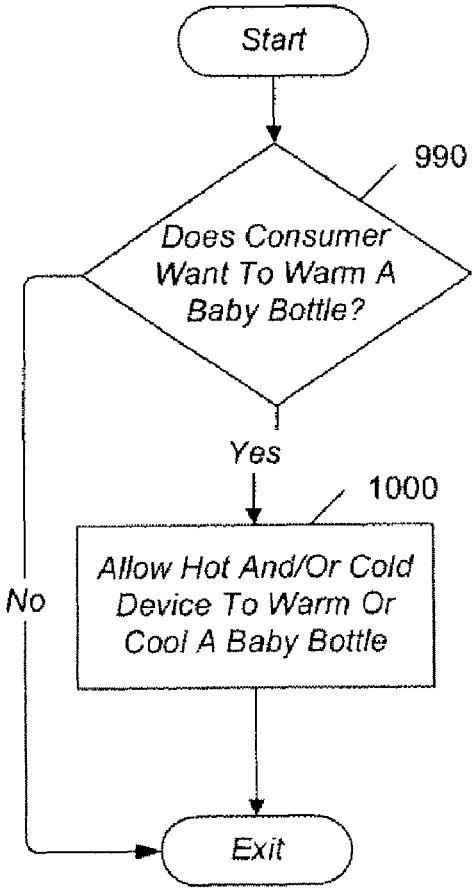
FIG. 17 is a flow chart of method steps for allowing a consumer to use the hot and/or cold device to warm or cool a baby bottle.

FIG. 17 shows one example of a method for allowing a consumer to use the hot and/or cold device 100 to warm or cool a product 50 in the form of a baby bottle. Specifically, the hot and/or cold device 100 may be utilized to heat or cool the baby bottle. This feature could be provided for a fee or this feature could be provided for free as a service to the community. In decision block 960, a determination is made as to whether a consumer wants to warm a baby bottle. If the result is in the affirmative then processing moves to block 1000. If the result is in the negative then the routine is exited.

Figure 18:
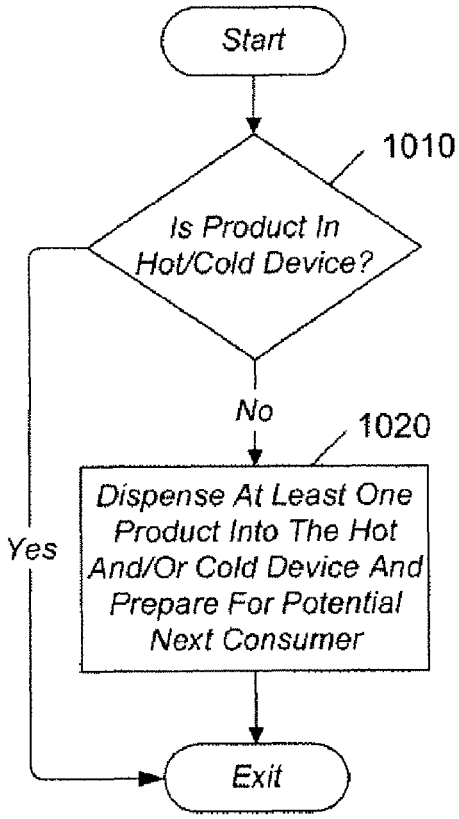
FIG. 18 is a flow chart of method steps for dispensing at least one product and preparing the product for a potential next consumer.

FIG. 18 shows one example of a method of dispensing at least one product 50 and preparing the product 50 for a potential next consumer. Specifically, the most popular product 50 may be pre-dispensed into the hot and/or cold device 100. In this regard, the popular product 50 may be temperature adjusted such that when a consumer makes a selection and the selection is the product 50 that has been pre-dispensed, then the product 50 may be immediately dispensed, at the desired product temperature, to the consumer.

In decision block 1010, a determination is made as to whether there is a beverage or other product 50 in the hot and/or cold device 100 to be heated or cooled. If the result is in the affirmative then the routine is exited. If the result is in the negative then processing moves to block 1020. In block 1020, at least one popular product 50 is dispensed into the hot and/or cold device 100 and prepared for potential dispense to the next consumer should the next consumer select the pre-prepared product 50. The routine is then exited.

Figure 19:
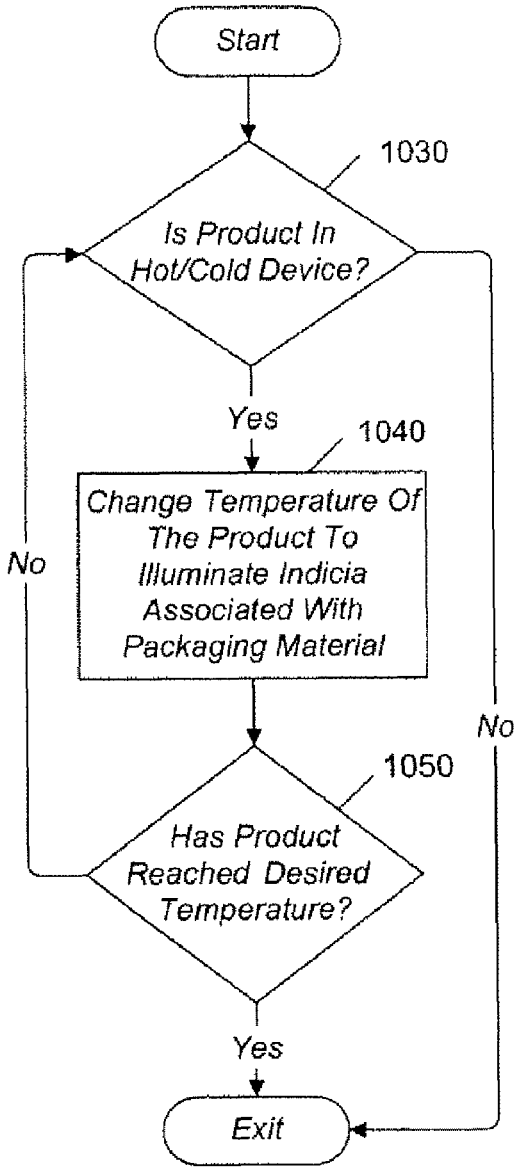
FIG. 19 is a flow chart of method steps for chilling or heating a beverage or other product to illuminate indicia associated with the packaging material of the beverage or other product.

FIG. 19 shows one example of a method of chilling or heating a beverage or other product 50 to illuminate indicia associated with the packaging material of the beverage or other product 50. Color changing and/or other illuminating text and indicia may be incorporated onto the product packaging. Specifically, thermochromatic inks may change color based on temperature of the product 50. A color recognition system using an light emitting diode or a charge coupled device could monitor and respond accordingly. Adjusting the temperature of the contents of the beverage or other product 50 also adjusts the temperature of the product packaging. Such temperature adjustments may be utilized to illuminate or otherwise reveal text and/or graphics on the product packaging.

In decision block 1030, a determination is made as to whether there is a beverage or other product 50 in the hot and/or cold device 100 waiting to be heated or cooled. If the result is in the affirmative then processing moves to block 1040. If the result is in the negative then the routine is exited. In block 1040, the temperature of the product 50 including the packaging is adjusted to the desired product temperature so as to illuminate indicia associated with the packaging material. In decision block 1050, a determination is made as to whether the beverage or other product 50 has reached the desired product temperature. If the result is in the affirmative then the routine is exited. If the result is in the negative then processing returns to decision block 1030.

Figure 20:
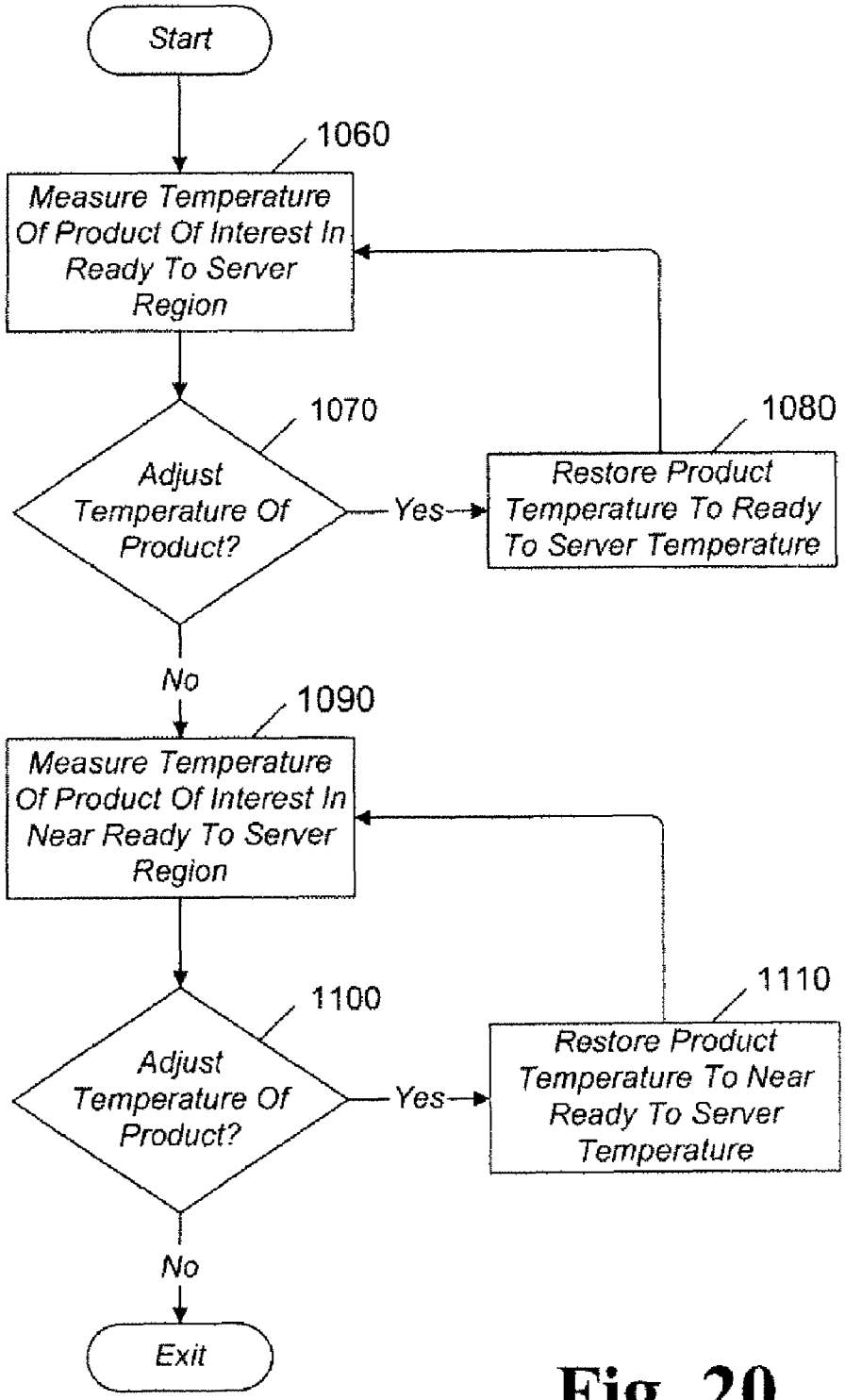
FIG. 20 is a flow chart of method steps for using a hot and/or cold device to cool a number of products to a ready to serve temperature, to cool a number of the products to a near ready to serve temperature, and to cool the remaining products to a desired refrigerated elevated temperature.

FIG. 20 shows one example of a method of using the hot and/or cold device 100 to cool certain of the products 50 to a ready to serve temperature, cool certain of the products 50 to a near ready to serve temperature, and cool the remaining products 50 to a desired refrigerated elevated temperature. It may be desirable to keep certain of the beverages or other products 50 at a ready to server temperature such that a consumer can easily access a product 50 that does not require additional preparation time. Because it is likely that those products 50 that are not immediately accessible to a consumer will not be select first, it may be desirable to keep such types of products 50 at a near ready to serve temperature. With regards to the remaining products 50 in inventory, maintaining a desired refrigerated elevated temperature may promote energy savings while protecting the product 50 from extreme temperature conditions.

In block 1060, a measurement of the temperature of the beverage or other product 50 of interest in the ready to serve region is effectuated. In decision block 1070, a determination is made as to whether the temperature of the beverage or other product 50 needs to be adjusted. If the result is in the affirmative then processing moves to block 1080. If the result is in the negative then processing moves to block 1090. In block 1080, the temperature of the beverage or other product 50 is adjusted to the ready to server temperature. In block 1090, a measurement of the temperature of the beverage or other product 50 in the near ready to server region is effectuated. In decision block 1100, a determination is made as to whether the temperature of the beverage or other product 50 needs to be adjusted. If the result is in the affirmative then processing moves to block 1110. If the result is in the negative then the routine is exited. In block 1110, the temperature of the beverage or other product 50 is adjusted to the near ready to server temperature. Processing then returns to block 1090.

Figure 21:
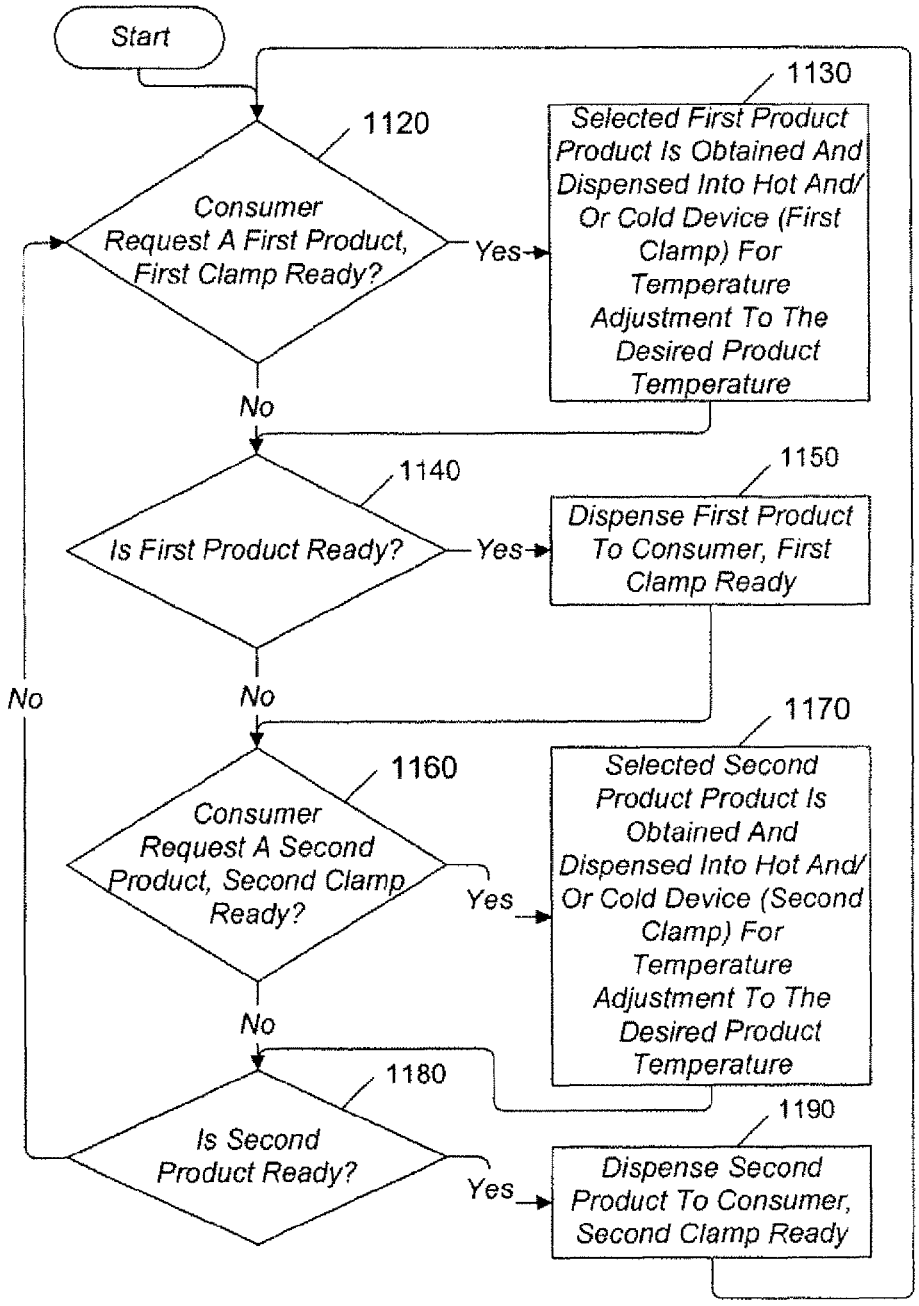
FIG. 21 is a flow chart of method steps for adjusting the temperature of a first product while obtaining and subsequently simultaneously adjusting the temperature of a second product.

FIG. 21 shows one example of a method of adjusting the temperature of a first product 50 while obtaining and simultaneously adjusting the temperature of a second product 50. A first vend may obtain a product 50 in one of the available clamps 105 while a second vend may be effectuated. Such a second vend results in obtaining a second product 50 and placing it in a second clamp 105 where temperature adjustment on the second product 50 may begin.

In decision block 1120, a determination is made as to whether a consumer has requested a first beverage or other product 50 to be dispensed and whether the first clamp 105 is ready and/or available. If the result is in the affirmative then processing moves to block 1130. If the result is in the negative then processing moves to decision block 1140. In block 1130, the consumer's first selected beverage or other product 50 is obtained and loaded into the first clamp 105 wherein the temperature is adjusted to the desired product temperature. In decision block 1140, a determination is made as to whether the first beverage or other product 50 is ready, indicating that the desired product temperature has been obtained. If the result is in the affirmative then processing moves to block 1150. If the result is in the negative then processing moves to decision block 1160. In block 1160, the first beverage or other product 50 is dispensed to the consumer and the first clamp 105 is made ready for the next selection.

In decision block 1160, a determination is made as to whether a consumer has requested a second beverage or other product 50 to be dispensed and whether the second clamp 105 is ready and/or available. If the result is in the affirmative then processing moves to block 1170. If the result is in the negative then processing moves to decision block 1180. In block 1170, the consumer's second selected beverage or other product 50 is obtained and loaded into the second clamp 105 wherein the temperature adjustment to the desired product temperature commences. In decision block 1180, a determination is made as to whether the second beverage or other product 50 is ready, indicating that the desired product temperature has been obtained. If the resultant is in the affirmative then processing moves to block 1190. If the resultant is in the negative then processing returns to decision block 1120. In block 1190, the second beverage or other product 50 is dispensed to the consumer and the second clamp 105 is made ready for the next selection. Processing then returns to decision block 1120.

In a preferred embodiment, the products 50 herein are temperature adjusted to the desired product temperature. In this regard, the products 50 may be heated or cooled. In another embodiment, the products 50 may be interchanged with food products such that the food products also may be heated or cooled. As such, both the beverages or other product 50 and food items may be heated or cooled by way of the hot and/or cold device 100 as may be desired.

The capabilities of the present invention may be implemented in software, firmware, hardware or some combination thereof. One or more aspects herein may be included in an article of manufacture (e.g., one or more computer program products) having, for instance, computer usable media. The media may be embodied in computer readable program code means for providing and facilitating the capabilities herein. The article of manufacture may be included as a part of a computer system or sold separately. Additionally, at least one program storage device readable by a machine may include at least one program of instructions executable by the machine to perform the capabilities of the present invention.

The flow diagrams depicted herein are just examples. There may be many variations to these diagrams or the steps (or operations) described therein without departing from the spirit of the invention. For instance, the steps may be performed in a differing order, or steps may be added, deleted or modified. All of these variations are considered a part of the claimed invention.

Although the preferred embodiment to the invention has been described, it will be understood that those skilled in the art, both now and in the future, may make various improvements and enhancements that fall within the scope of the claims, which follow. These claims should be construed to maintain the proper protection for the invention first described.

We claim:

1. A method of adjusting a temperature of a product to a desired product temperature, comprising:

maintaining a product storage area with the product therein;

maintaining a main refrigerated or heated space at a temperature either less or greater than the desired product temperature;

enabling the selection of the product;

enabling the selection of the desired product temperature;

enabling the placement of the product into a temperature adjust device;

circulating a liquid or a gas from the main refrigerated or heated space through the temperature adjust device, the liquid or the gas having been cooled to a cool temperature less than the desired product temperature or heated to a warm temperature greater than the desired product temperature;

determining when the desired product temperature has been obtained; and ceasing circulation of the liquid or gas through the temperature adjust device.

2. The method of claim 1, wherein the product is stored at a refrigerated elevated temperature.

3. The method of claim 1, further comprising agitating the product by using ultrasound or high frequency signals.

4. The method of claim 1, further comprising communicating with a wireless device to obtain a plurality of consumer preferences including the desired product temperature preference.

5. The method of claim 1, further comprising displaying a time remaining until the product obtains the desired product temperature.

6. The method of claim 1, further comprising communicating with a wireless device to effectuate payment for the product.

7. The method of claim 1, further comprising determining the desired product temperature in part by determining a consumer's body temperature.

8. The method of claim 1, further comprising informing a consumer that the product has reached the desired product temperature.

9. The method of claim 1, further comprising frosting indicia onto a package for the product.

10. The method of claim 1, further comprising allowing the temperature adjust device to return to ambient temperature.

11. A system for adjusting a temperature of a product to a desired product temperature, comprising:

a temperature adjust device;

a main space maintained at a temperature either less or greater than the desired product temperature; and a circulation device;

wherein responsive to a product being placed in the temperature adjust device, the circulation device circulates a liquid or a gas from the main space through the temperature adjust device until the product has transitioned to the desired product temperature.

12. The system of claim 11, further comprising an agitator for agitation of the product.

13. The system of claim 11, further comprising a product storage area maintained at a refrigerated elevated temperature.

14. The system of claim 11, wherein the temperature adjust device comprises a frost inlet for frosting the product.

15. The system of claim 11, further comprising a consumer interface such that a consumer can select the desired product temperature.

16. The system of claim 11, further comprising a wireless device interface for communicating consumer preferences or payment information.

17. The system of claim 11, further comprising a temperature sensor.

18. The system of claim 17, wherein the temperature sensor comprises an infra-red temperature sensor.

19. The system of claim 11, further comprising a biometric sensor.

20. The system of claim 11, wherein the temperature adjust device comprises a clamp.

21. A method of empowering consumers to select a desired product temperature of a product at a point of consumption, comprising:

allowing a consumer to request the product, the product being stored at a temperature either higher or lower than the desired product temperature;

maintaining a main refrigerated or heated space at a temperature either less or greater than the desired product temperature;

prompting the consumer to select the desired product temperature; and transitioning the product to the desired product temperature by circulating a liquid or a gas from the main refrigerated or heated space through a temperature adjust device.

22. The method of claim 21, further comprising determining a rate of temperature change of the product.

23. The method of claim 21, further comprising displaying an amount of time remaining until the product completes transition to the desired product temperature.

24. The method of claim 21, further comprising obtaining a plurality of consumer preferences from a wireless device.

25. The method of claim 21, wherein the prompting includes measuring the temperature of the consumer to determine in part the desired product temperature.

26. The method of claim 21, further comprising allowing the consumer to provide a text or a graphic indicia.

27. The method of claim 26, further comprising frosting the text or the graphic indicia onto a package for the product.

28. The method of claim 21, further comprising agitating the product.

29. The method of claim 21, further comprising determining the desired product temperature in part by determining a consumer's body temperature.

30. An apparatus for a number of products, comprising:

a mechanism for storing the number of products; and a temperature adjust device operationally related to the mechanism;

the temperature adjust device comprising a clamp; and wherein the temperature adjust device circulates a liquid or a gas through the clamp when one of the number of products is therein so as to obtain a desired product temperature;

wherein the mechanism comprises a heat rejection space maintained at a warm temperature greater than the desired product temperature.

31. The apparatus of claim 30, wherein the mechanism comprises a main refrigerated space maintained at a cool temperature less than the desired product temperature.

32. The apparatus of claim 31, wherein the temperature adjust device comprises an agitator.

33. The apparatus of claim 32, wherein the agitator comprises ultrasound or high frequency signals.

34. The apparatus of claim 30, further comprising a consumer interface accessible to a consumer.

35. The apparatus of claim 30, wherein the mechanism comprises an 'X'-'Y' picker.

36. The apparatus of claim 30, wherein the mechanism comprises a vending machine, a cooler, or a fountain dispenser.

37. The apparatus of claim 30, further comprising an infra-red temperature sensor.

* * * * *